US005624496A

United States Patent [19]

Scharf et al.

[11] Patent Number: 5,624,496

[45] Date of Patent: Apr. 29, 1997

[54] AUTOMATED COATING SYSTEM

[75] Inventors: Donald R. Scharf, Amherst; Raymond J. Baxter, Vermilion, both of Ohio

[73] Assignee: Nordson Corporation, Westlake, Ohio

[21] Appl. No.: 447,431

[22] Filed: May 23, 1995

[51] Int. Cl.[6] ..... B05C 5/00

[52] U.S. Cl. ..... 118/320; 118/56; 118/314

[58] Field of Search ..... 118/56, 57, 58, 118/66, 300, 313, 314, 320, DIG. 2, 64, 319, 305

[56] References Cited

U.S. PATENT DOCUMENTS

| | | | |
|---|---|---|---|
| 5,088,443 | 2/1992 | Hastings et al. . | |
| 5,171,613 | 12/1992 | Bok et al. | 427/422 |
| 5,221,347 | 6/1993 | Heine | 118/630 |
| 5,248,529 | 9/1993 | Hammond et al. | 427/558 |

*Primary Examiner*—Laura Edwards
*Assistant Examiner*—Steven B. Leavitt
*Attorney, Agent, or Firm*—Tarolli, Sundheim, Covell Tummino & Szabo

[57] ABSTRACT

An automated coating system includes a first coating station where a coating material is sequentially applied to bearing assemblies while a first side of each bearing assembly faces upward. A conveyor sequentially moves the bearing assemblies to a turning station where the bearing assemblies are turned over. The conveyor then moves the bearing assemblies to a second coating station where coating material is sequentially applied to the bearing assemblies while second sides of the bearing assemblies face upward. The conveyor then moves the bearing assemblies to a rotating station where an inner bearing race is rotated relative to an outer bearing race to promote even distribution of the coating material.

30 Claims, 11 Drawing Sheets

AUTOMATED COATING SYSTEM

BACKGROUND OF THE INVENTION

The present invention relates to an automated coating system which may be utilized to coat bearing assemblies.

Prior to the present invention, employees of a bearing manufacturer conducted an experiment in regard to the coating of bearing assemblies. The apparatus used by the bearing manufacturer employees in conducting the experiment is illustrated schematically in FIG. 1. The apparatus included a cylindrical housing 20 having a chamber 22 into which a tray 24 was manually inserted. The tray 24 had a perforated support surface 26 upon which a bearing assembly 28 was supported.

When the tray 24, with the bearing assembly 28 supported therein, had been manually inserted into the chamber 22, an ultrasonic atomizer 32 was operated to direct a flow of coating material into the chamber 22. Air was conducted into the chamber 22 from an inlet conduit 34. Air was conducted from the chamber 22 through an outlet conduit 36.

Thereafter, the tray 24 was manually pulled out of the housing 20. The bearing assembly 28 was manually turned over so that an axially opposite side of the bearing assembly 28 faced upward. The tray 24 was then manually inserted back into the chamber 22. The ultrasonic atomizer 32 was again operated to spray coating material into the chamber 22 while a flow of air was conducted from the conduit 34 through the chamber to the conduit 36. The tray 24 was then manually pulled out of the housing 20. The bearing assembly 28 was manually removed from the tray 24 and the bearing races were rotated.

Although an ultrasonic atomizer 32 was utilized to dispense coating material during the foregoing experiment, it was contemplated by the employees of the bearing manufacturer that other coating systems could be utilized. Specifically, it was contemplated that the "Unicarb" (trademark) process of Union Carbide Chemicals and Plastics Technology Corporation of Danbury, Conn. could be utilized to coat the bearing assembly. A known method and apparatus which may be used with the "Unicarb" (trademark) process is disclosed in U.S. Pat. No. 5,088,443 issued Feb. 18, 1992 and entitled "Method and Apparatus for Spraying a Liquid Coating Containing Supercritical Fluid or Liquified Gas" and U.S. Pat. No. 5,215,253 issued Jun. 1, 1993 and entitled "Method and Apparatus for Forming and Dispersing Single and Multiple Phase Coating Material Containing Fluid Diluent".

SUMMARY OF THE INVENTION

The present invention provides a new and improved automated coating system. Although the automated coating system may be used to coat many different articles, it is advantageously utilized to sequentially coat bearing assemblies having inner and outer races.

The automated coating system includes a first coating station where coating material is applied to each of the bearing assemblies in turn while a first side of each bearing assembly faces upward. A conveyor sequentially moves bearing assemblies from the first coating station to a turning station. At the turning station, the bearing assemblies are turned over. The conveyor moves the bearing assemblies from the turning station to a second coating station where coating material is applied to each of the bearing assemblies in turn. The conveyor then sequentially moves the bearing assemblies to a rotating station where relative rotation occurs between the inner and outer races of the bearing assemblies.

At each of the coating stations, a housing has a chamber into which the bearing assemblies are sequentially moved. A coating material flow control apparatus directs a flow of coating material and compressed fluid into the chamber to form an aerosol of fine particles of coating material in the chamber. The coating material and compressed fluid may advantageously be supplied to the coating material flow control apparatus at the coating stations as a mixture which is conducted from an accumulator to the coating material flow control apparatus.

BRIEF DESCRIPTION OF THE DRAWINGS

The foregoing and other features of the invention will become more apparent upon a consideration of the following description taken in connection with the accompanying drawings, wherein.

DESCRIPTION OF SPECIFIC PREFERRED EMBODIMENTS OF THE INVENTION

General Description

Figure 1:
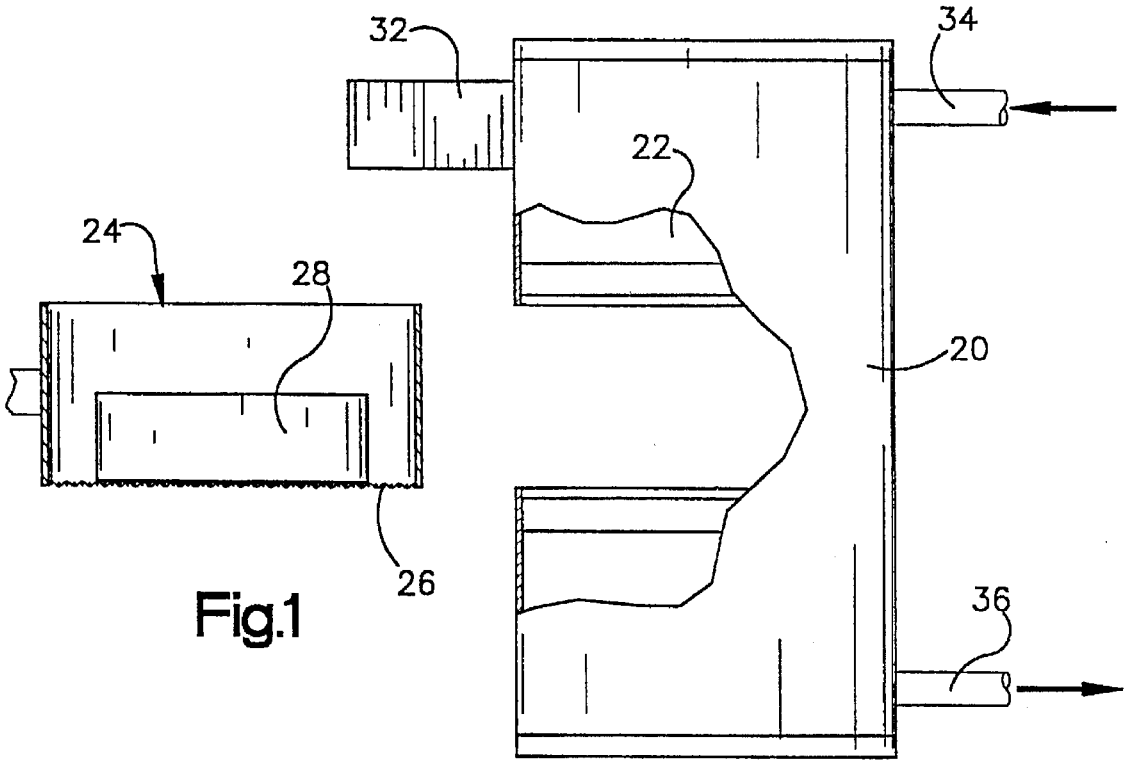
FIG. 1 is a schematic illustration of apparatus used in an experiment by employees of a bearing manufacturer.
Figure 2:
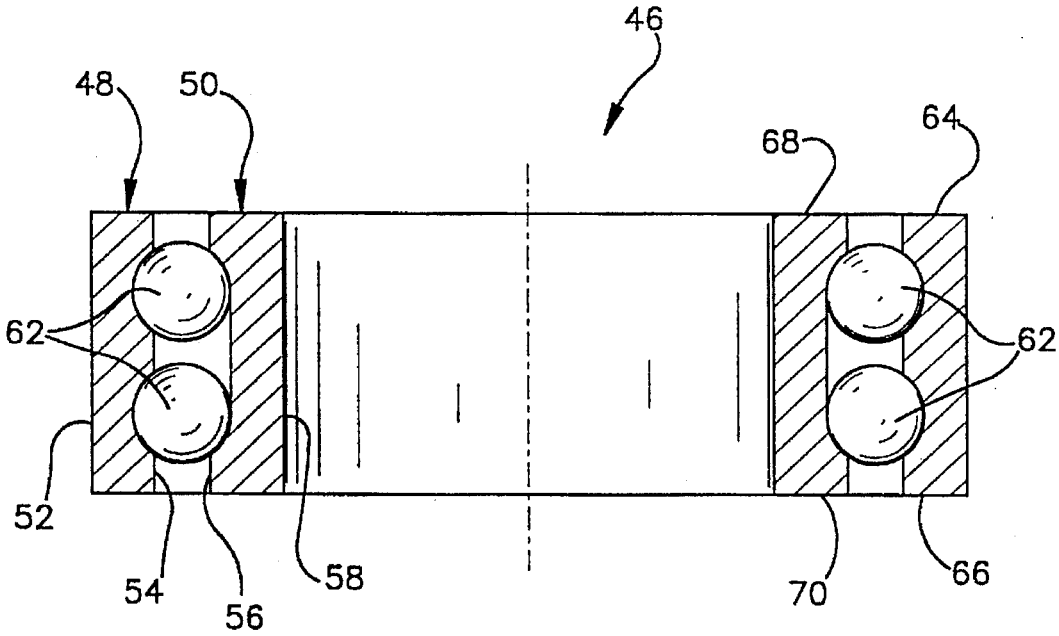
FIG. 2 is an enlarged sectional view of a bearing assembly having inner and outer races.

An automated coating system 44 (FIG. 3) constructed in accordance with the present invention may be used to coat many different types of articles. However, the automated coating system 44 is advantageously used to coat a bearing assembly 46 (FIG. 2). The bearing assembly 46 has an annular outer race 48 and an annular inner race 50. The annular outer race 48 has a cylindrical outer side surface 52 and a generally cylindrical inner side surface 54. The inner race 50 has a generally cylindrical outer side surface 56 and a cylindrical inner side surface 58.

Spherical ball bearings 62 are disposed in engagement with the inner side surface 54 of the outer race 48 and the outer side surface 56 of the inner race 50. The outer race 48 has flat opposite annular end surfaces 64 and 66. Similarly, the inner race 50 has opposite flat annular end surfaces 68 and 70. The ball bearings 62 support the outer and inner races 48 and 50 for rotation relative to each other.

An infeed conveyor 74 (FIG. 3) sequentially transports bearing assemblies 46 to the automated coating system 44. An outfeed conveyor 76 sequentially transports coated bearing assemblies 46 from the automated coating system 44. The automated coating system 44 includes a rotary conveyor 78 which sequentially moves bearing assemblies between operating stations in the automated coating system 44.

Figure 3:
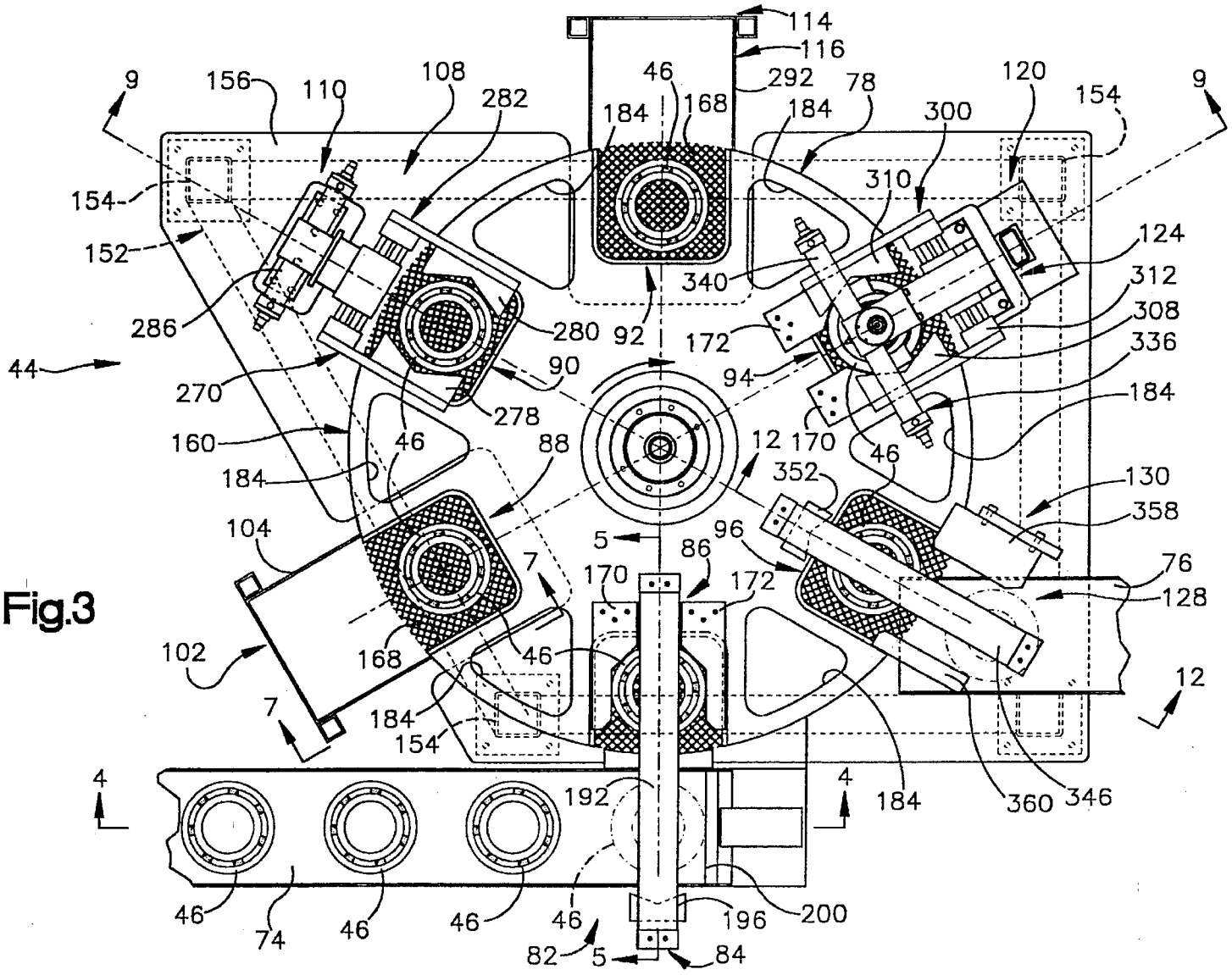
FIG. 3 is a plan view of an automated coating system constructed in accordance with the present invention to coat bearing assemblies.
Figure 5:
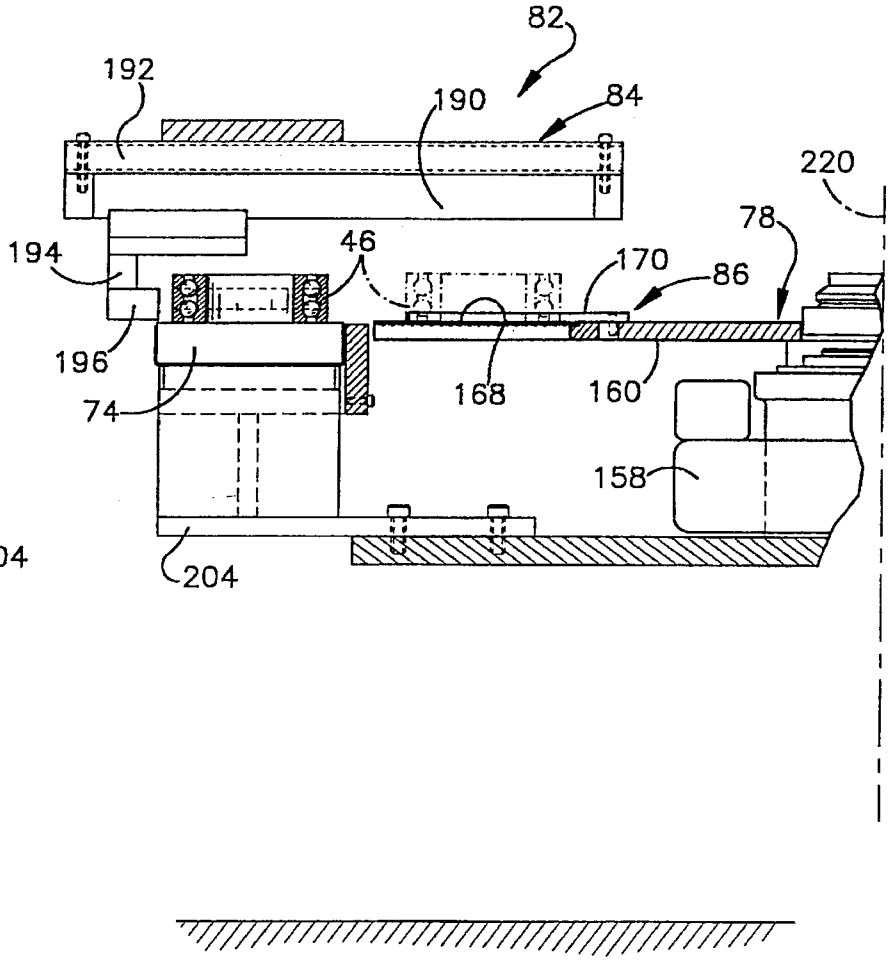
FIG. 5 is a fragmentary sectional view, taken generally along the line 5—5 of FIG. 3, illustrating a loader assembly at the loading station.
Figure 4:
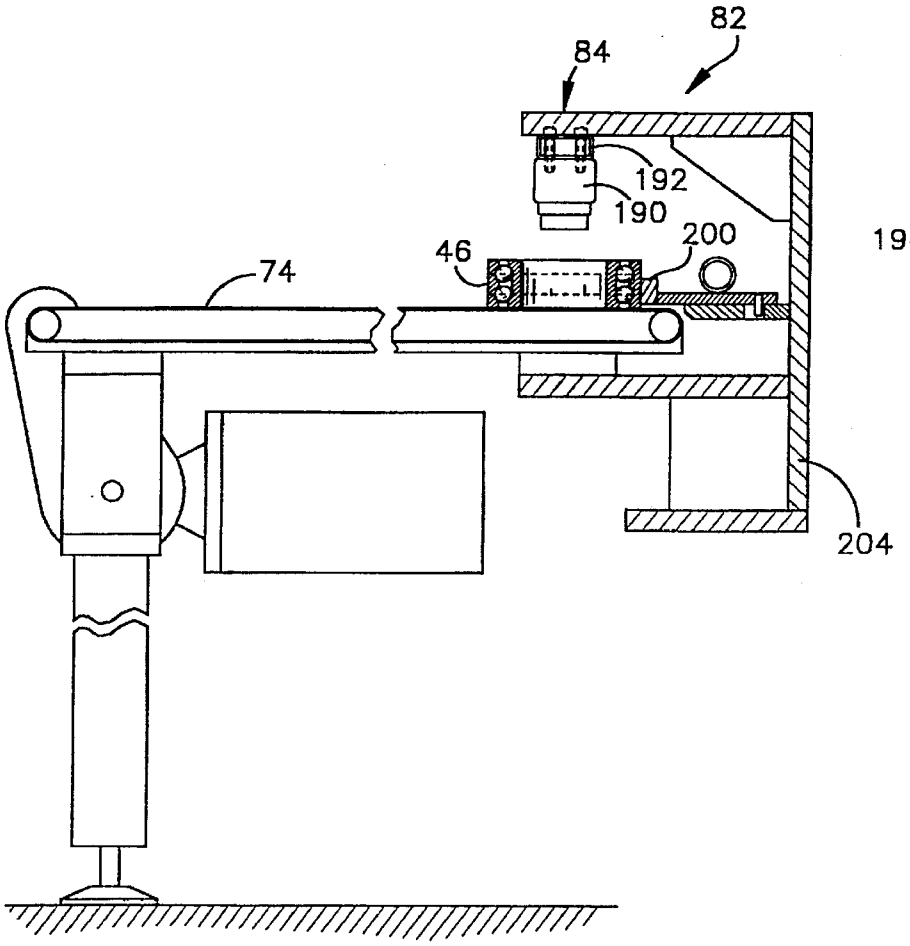
FIG. 4 is a fragmentary sectional view, taken generally along the line 4—4 of FIG. 3, illustrating an infeed conveyor which moves bearing assemblies to a loading station.

The operating stations in the automated coating system 44 include a loading station 82 (FIGS. 3, 4 and 5). A loader assembly 84 is disposed at the loading station 82. The loader assembly 84 is operable to sequentially move bearing assemblies 46 from the infeed conveyor 74 the rotary conveyor 78 (FIG. 3).

The rotary conveyor 78 has receiving locations 86, 88, 90, 92, 94, and 96 (FIG. 3) which are sequentially moved to the loading station 82. When the rotary conveyor 78 is in the position shown in FIG. 3, the receiving location 86 is at the loading station 82. The loader assembly 84 sequentially loads bearing assemblies 46 into the receiving locations 86, 88, 90, 92, 94 and 96 as the rotary conveyor 78 is indexed in a clockwise direction (as viewed in FIG. 3) to move each of the receiving locations in turn to the loading station 82.

A first coating station 102 is disposed adjacent to the loading station 82. Coating apparatus 104 (FIGS. 3, 7 and 8) is located at the first coating station 102. The coating apparatus 104 is operable to apply coating material to each of the bearing assemblies 46 in turn while first axial sides 64 and 68 (FIG. 2) of the outer and inner bearing races 48 and 50 face upward.

Figure 9:
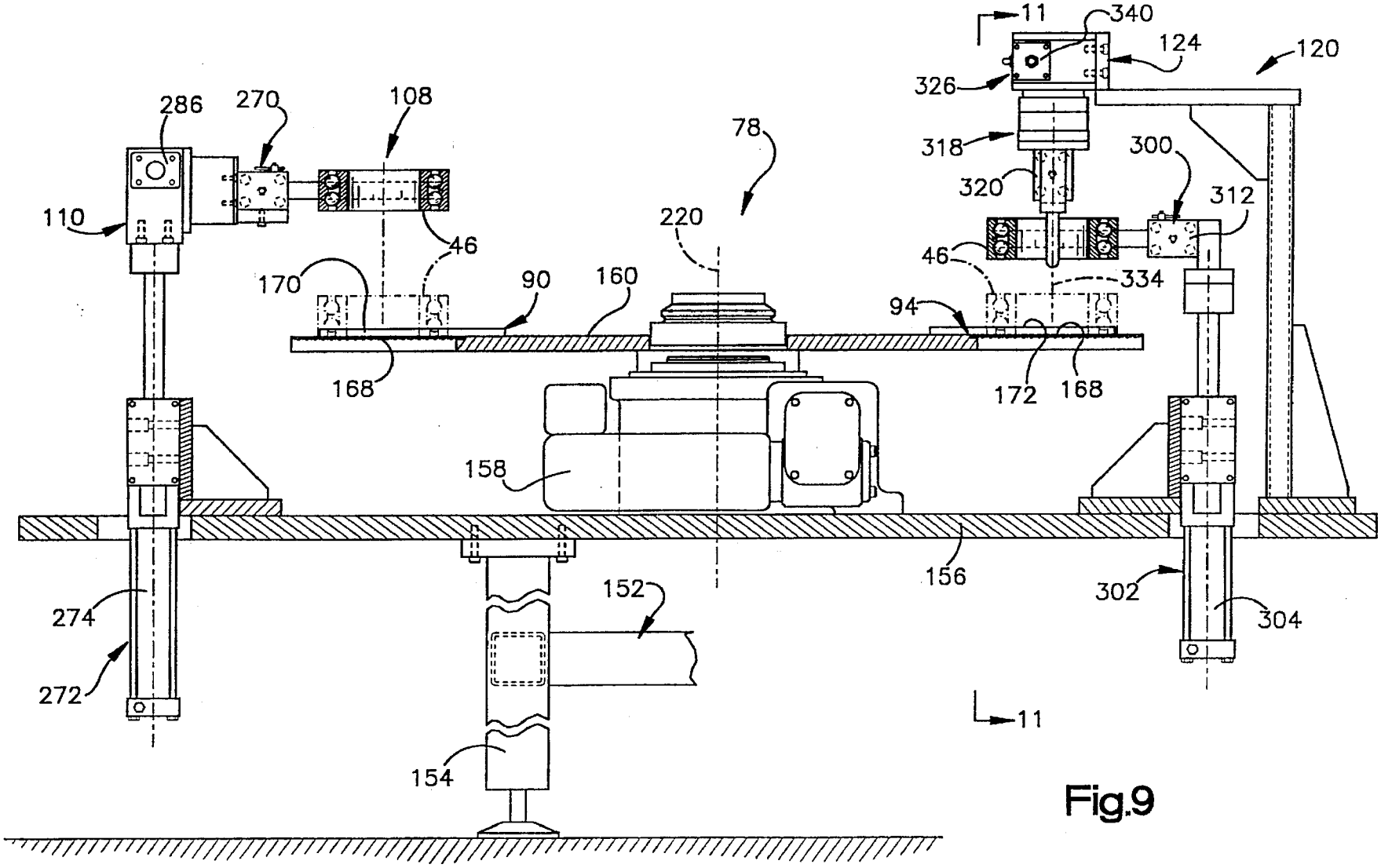
FIG. 9 is a fragmentary sectional view, taken generally along the line 9—9 of FIG. 3, illustrating turning apparatus at a turning station and rotating apparatus at a rotating station.

From the first coating station 102, the bearing assemblies 46 are sequentially moved to a turning station 108 (FIGS. 3 and 9). At the turning station 108, turning apparatus 110 is operable to turn each of the bearing assemblies over so that the opposite side of the bearing assembly faces upward. Thus, the turning apparatus 110 turns the bearing assemblies 46 from an orientation in which the axial end surfaces 64 and 68 (FIG. 2) on the outer and inner races 48 and 50 face upward to an orientation in which the end surfaces 66 and 70 on the outer and inner races 48 and 50 face upward.

The bearing assemblies 46 are then sequentially moved to a second coating station 114 (FIG. 3). Coating apparatus 116 at the second coating station 114 applies coating material to each of the bearing assemblies 46 in turn. The coating apparatus 116 has the same construction as the coating apparatus 104 at the first coating station 102. The coating apparatus 116 applies coating material to each of the bearing assemblies 46 in turn while the end surfaces 66 and 70 (FIG. 2) on the outer and inner races 48 and 50 face upward.

Figure 10:
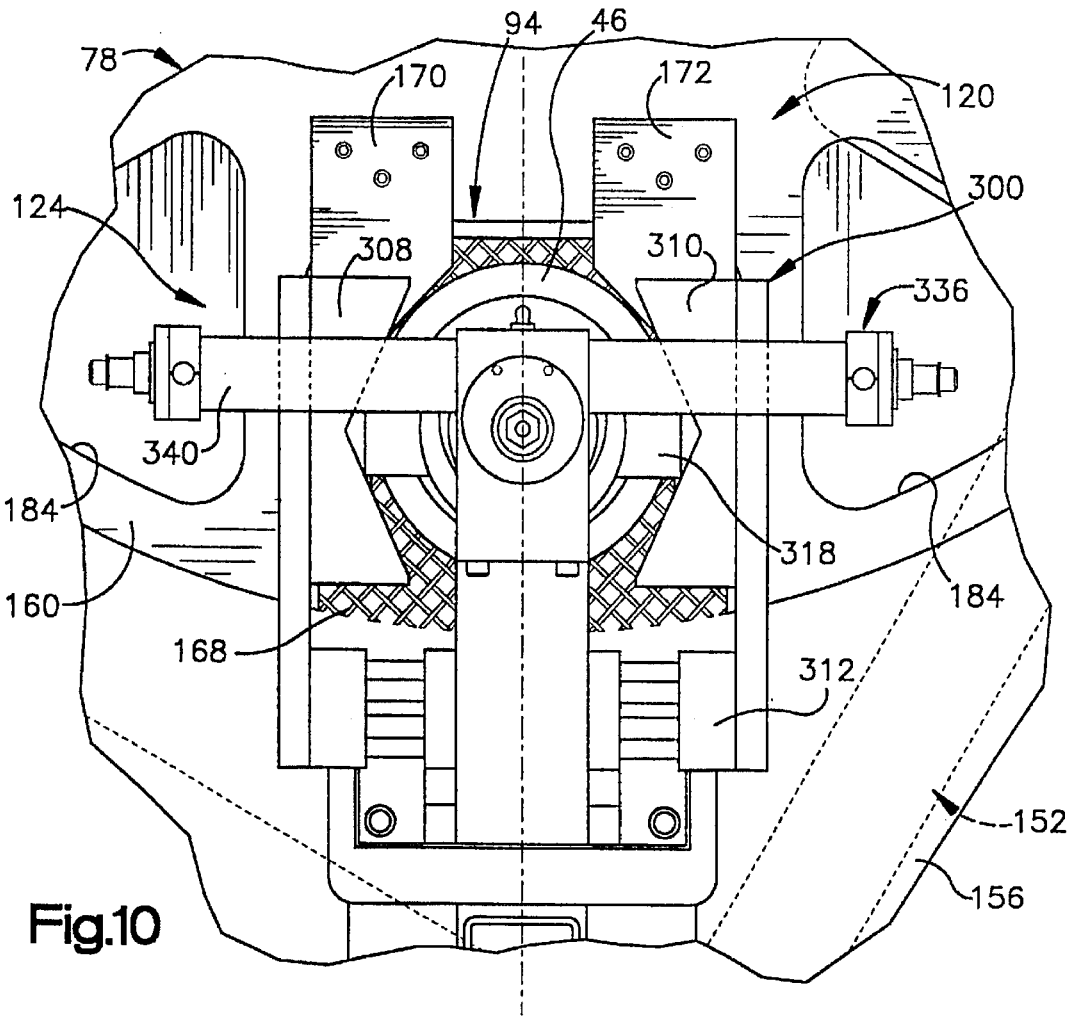
FIG. 10 is an enlarged plan view of a portion of FIG. 3, illustrating the apparatus at the rotating station.

The bearing assemblies 46 are then sequentially moved to a rotating station 120 (FIGS. 3, 9, and 10). A rotating apparatus 124 (FIGS. 9 and 11) is operable to provide relative rotation between the outer race 48 and inner race 50 (FIG. 2) of the bearing assemblies 46. During relative rotation between the outer race 48 and inner race 50 of a bearing assembly 46, the ball bearings 62 roll along the inner side surface 54 of the outer bearing race 48 and along the outer side surface 56 of the inner bearing race 50. This promotes a relatively even distribution of coating material on the various components of the bearing assembly 46.

Figure 12:
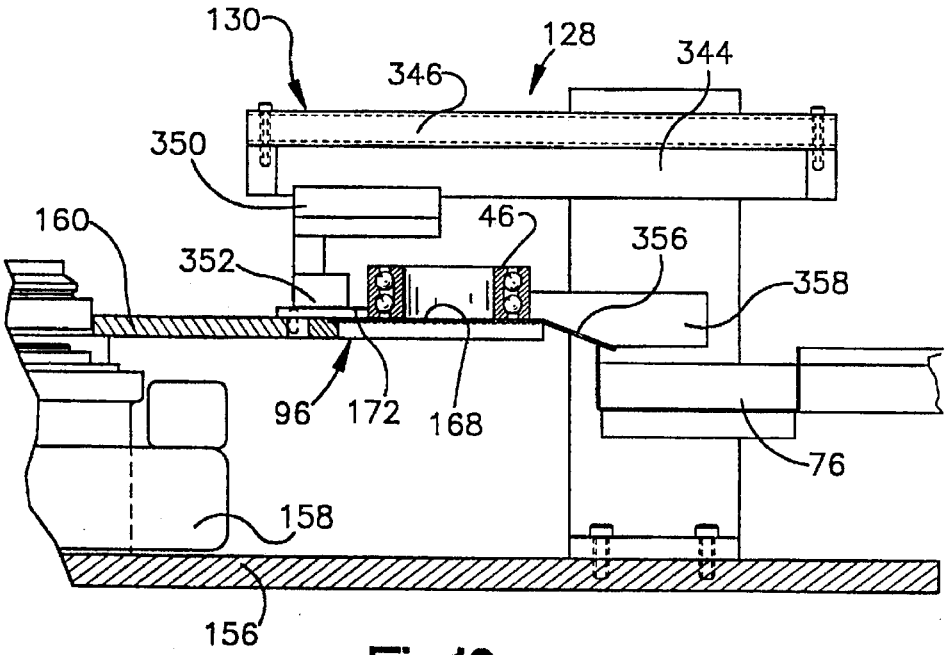
FIG. 12 is a fragmentary elevational view, taken generally along the line 12—12 of FIG. 3, illustrating apparatus at an unloading station.

The bearing assemblies 46 are then sequentially moved to an unloading station 128 (FIGS. 3 and 12). An unloader assembly 130 sequentially moves the bearing assemblies 46 onto the outfeed conveyor 76. The outfeed conveyor 76 moves the bearing assemblies to a remote location for further processing which may, for example, include packaging.

In the embodiment of the invention illustrated in FIG. 3, the automated coating system 44 includes a circular rotary conveyor 78 which sequentially moves the bearing assemblies 46 from the loading station 82 through the first coating station 102, turning station 108, second coating station 114, and rotating station 120 to the unloading station 128. However, it is contemplated that a linear conveyor arrangement could be utilized to sequentially move the bearing assemblies 46 between the various stations of the automated coating system 44. Of course, if this was done, the operating stations would be arranged in a linear array rather than a circular array. It is also contemplated that the automated coating system 44 could be provided with additional stations where other operations are performed on the bearing assemblies 46. For example, the automated coating system 44 could include a cleaning station or additional coating stations if desired.

At the first and second coating stations 102 and 114 (FIG. 3), the bearing assemblies 46 are exposed to an aerosol which contains fine particles of coating material. This aerosol is formed by conducting a mixture of coating material and compressed fluid to the first and second coating stations 102 and 114. At the coating stations 102 and 114, the compressed fluid in the mixture expands and forms an aerosol of fine coating material particles.

A mixer system 134 (FIG. 13) is used to prepare the mixture of coating material and compressed fluid. The compressed fluid is preferably a supercritical fluid. The term "supercritical fluid" as used herein is intended to refer to a gas in a state above or close to its critical pressure and critical temperature and wherein the gas has a density which at least approaches that of a liquid material. It is also contemplated that liquified gases could be utilized in place of supercritical fluids.

Many different compressed fluids can be intermixed with the liquid coating material to produce a solution which can be dispensed to form an aerosol of fine coating material particles. These include carbon dioxide, ammonia, water, nitrogen oxide, methane, ethane, ethylene, propane, pentane, methanol, ethanol, isopropanol, isobutanol, chlorotrifluoromethane, monofluoromethane, and others.

One presently preferred mixture includes liquid coating material containing supercritical carbon dioxide of the type sold in connection with the "Unicarb" (trademark) system of the Union Carbide Chemicals and Plastics Technology Corporation of Danbury, Conn. In the "Unicarb" (trademark) system, supercritical carbon dioxide is maintained in solution in the liquid coating material under suitable temperature and pressure conditions. However, it is contemplated that the compressed fluid may not be in a true supercritical condition and may only be in a condition which approaches a supercritical condition. By using carbon dioxide as the compressed fluid in the mixture of coating material and compressed fluid, environmental hazards are avoided, or at least minimized, during operation of the automated coating system 44 (FIG. 3).

Figure 13:
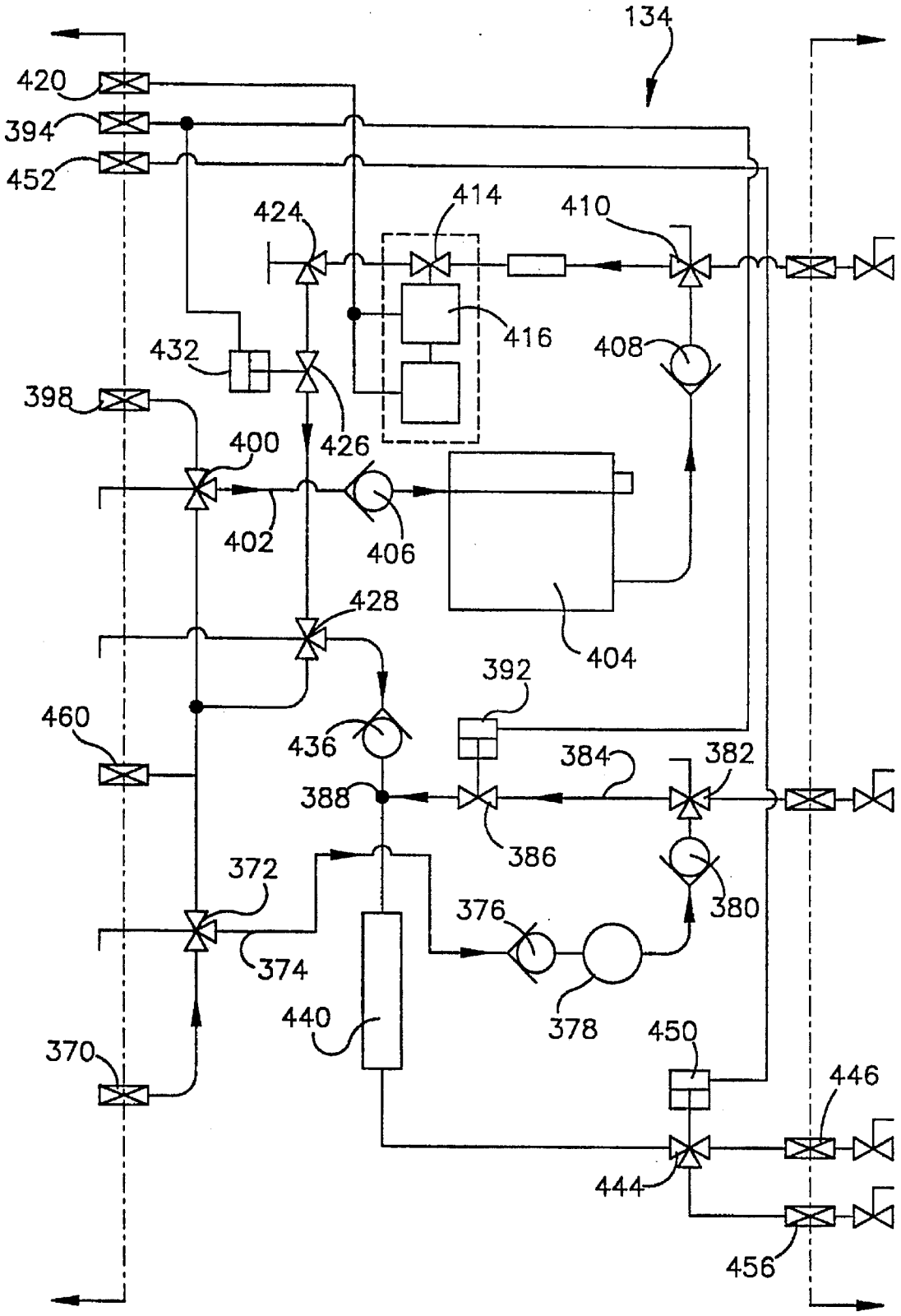
FIG. 13 is a schematic illustration of a mixer system which forms a mixture of coating material and compressed fluid.
Figure 14:
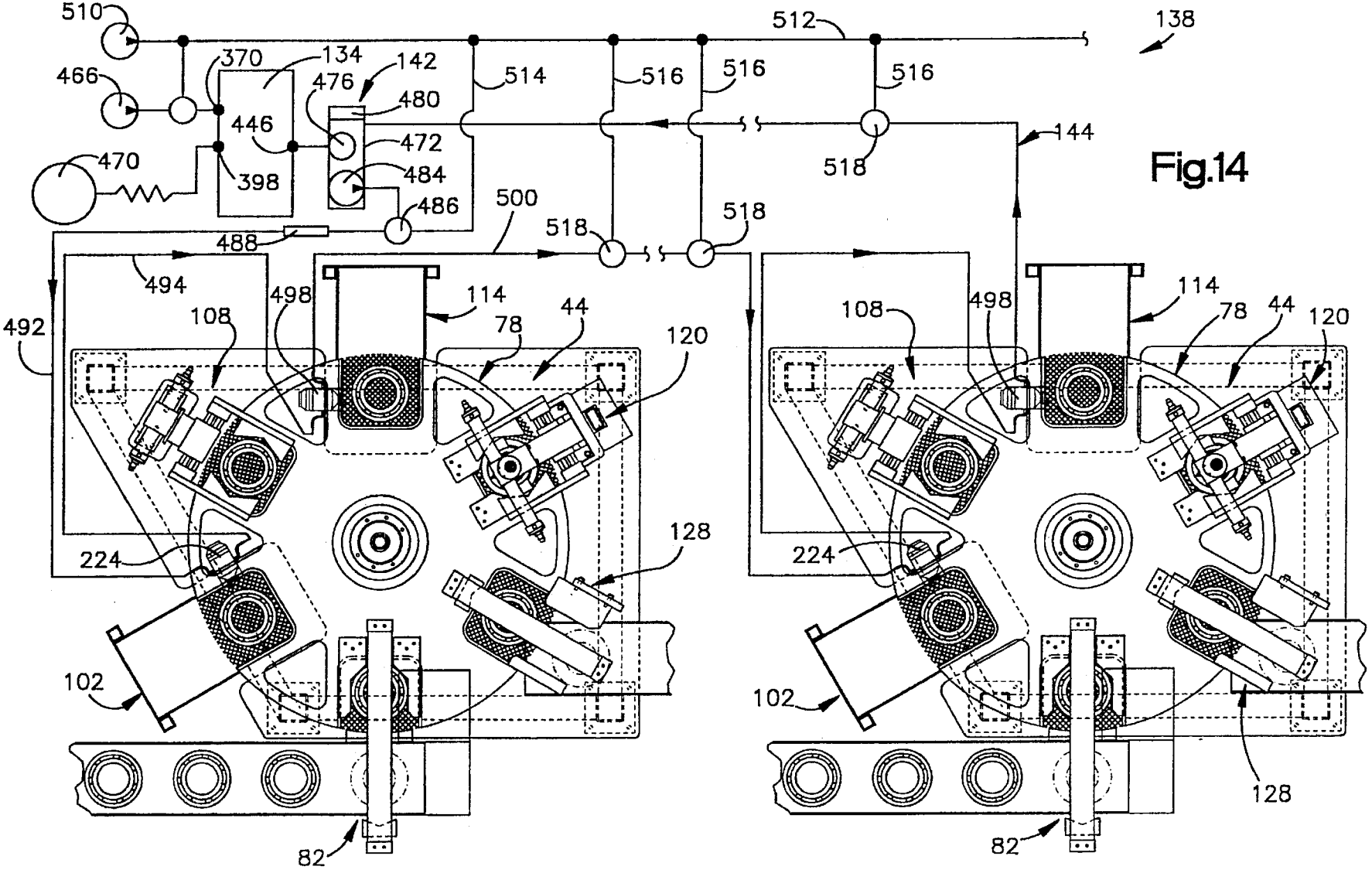
FIG. 14 is a schematic illustration of a combined automated coating system.

It is contemplated that a plurality of the automated coating systems 44 may be interconnected in such a manner as to form a combined automated coating system 138 (FIG. 14). The combined automated coating system 138 is connected with the mixer system 134 of FIG. 13. The mixer system 134 supplies a mixture of coating material and compressed fluid to an accumulator 142. The mixture of coating material and compressed fluid is conducted from the accumulator 142 through a manifold loop 144 to automated coating systems 44 in the combined automated coating system 138.

Rotary Conveyor

The rotary conveyor 78 sequentially moves bearing assemblies 46 from the loading station 82 through the first coating station 102, turning station 108, second coating station 114, and rotating station 120 to the unloading station 128. The rotary conveyor 78 includes a frame 152 (FIGS. 3 and 9) having vertical support posts 154 which support a flat horizontal base plate 156. A drive assembly 158 (FIG. 9) is mounted on the base plate 156 and is connected with a circular turntable 160. The turntable 160 supports the bearing assemblies 46 as they are moved to and from the operating stations in the automated coating system 44.

The drive assembly 158 is operable to rotate the horizontal turntable 160 in a clockwise direction (as viewed in FIG. 3) relative to the base plate 156 and frame 152 about a vertical central axis. The drive assembly 158 is operable to intermittently rotate the turntable 160 to move each of the receiving locations 86, 88, 90, 92, 94 and 96 on the turntable 160 along a horizontal circular path to a next succeeding one of the stations 84, 102, 108, 114, 120 and 128. The turntable 160 is intermittently rotated in a clockwise direction (as viewed in FIG. 3) in 60° increments. Of course, if a greater or lesser number of stations is associated with the turntable 160, the incremental distance through which the turntable is rotated would be different.

The drive assembly 158 (FIG. 9) is a commercially available cam-type intermittent drive which is driven by an electric motor. An overload clutch is provided in the drive assembly 158 to protect the cam drive against excessive loads. It should be understood that any one of many different known types of intermittent drives could be used in the drive assembly 158 to index the turntable 160.

The receiving locations 86–96 (FIG. 3) on the turntable 160 have the same construction. The receiving locations 86–96 are spaced equal distances apart in an annular array along the periphery of the turntable 160. The receiving location 86 (FIG. 6) includes a generally rectangular opening 166 formed in the periphery of the turntable 160. A stainless steel support screen or mesh 168 is disposed in the opening 166. The bearing assembly 46 is supported on the support screen or mesh 168.

A pair of positioning members 170 and 172 (FIG. 6) are connected with the turntable 160 at each of the receiving locations 86–96. The positioning members 170 and 172 position the bearing assemblies 46 relative to the receiving locations. Thus, the positioning members 170 and 172 have sloping side surfaces 174 and 176. The side surfaces 174 and 176 engage the cylindrical outer side surface 52 (FIG. 2) on the outer race 48 of the bearing assembly 46 to position the bearing assembly relative to the receiving location 86 in the manner shown in FIG. 6.

In addition, the positioning members 170 and 172 have parallel longitudinally extending side surfaces 178 and 180. The side surfaces 178 and 180 are spaced apart by a distance which is slightly greater than the outside diameter of a bearing assembly 46. The side surfaces 178 and 180 to retain the bearing assembly 46 in a central portion of the receiving location 86 during rotation of the turntable 160.

The horizontal positioning members 170 and 172 are relatively thin so that they project a relatively small distance upward from a horizontal upper side of the turntable 160 (FIG. 9). Therefore, the bearing assemblies 46 extend upward past the positioning members 170 and 172 to enable the upper portion of the bearing assemblies to be engaged while the bearing assemblies are disposed between the positioning members 170 and 172. The positioning members 170 and 172 are releasably connected with the turntable 160 so that different size positioning members can be provided for different size bearing assemblies.

Although the positioning members 170 and 172 have been shown at only the receiving locations 86 and 94 in FIG. 3, it should be understood that there are positioning members 170 and 172 at each of the receiving locations 86, 88, 90, 92, 94 and 96. The positioning members at the receiving locations 88, 90, 92, and 96 have been omitted in FIG. 3 in order to more clearly illustrate the relationship of the bearing assemblies 46 to apparatus at the various stations through which the bearing assemblies are sequentially moved by the rotary conveyor 78.

Generally triangular openings 184 (FIG. 3) are formed in the turntable 160 between the receiving locations 86–96. The openings 184 allow air to pass through the turntable 160 during movement of the openings 184 through the first coating station 102 and the second coating station 114.

Loading Station

At the loading station 82 (FIGS. 3 and 5) the loader assembly 84 is operable to sequentially move bearing assemblies 46 from the infeed conveyor 74 along a linear path to the receiving locations 86-96 on the turntable 160. The loader assembly 84 includes a piston and cylinder type motor 190 (FIGS. 4 and 5) which is supported on a beam 192 (FIGS. 3 and 5). The beam 192 and motor 190 have parallel horizontal longitudinal axes which intersect a vertical central axis of the rotary conveyor 78. The longitudinal axes of the beam 192 and motor 190 are disposed in a vertical plane which extends radially through the turntable 160.

Upon operation of the motor 190, a carriage 194 (FIG. 5) is moved axially along the motor 190 and beam 192. A pusher 196 is connected with the carriage 194 and is engageable with a bearing assembly 46. The pusher 196 pushes the bearing assembly 46 rightward (as viewed in FIG. 5) from the position shown in solid lines on the infeed conveyor 74 to the position shown in dashed lines on the turntable 160. Once the bearing 46 has been pushed onto the turntable 160, the direction of operation of the motor 190 is reversed to move the carriage 194 back to the position shown in FIG. 5.

A next succeeding bearing assembly 46 is then moved by the infeed conveyor 74 to the loading station 82 (FIG. 4). At the loading station 82, a leading portion of the bearing assembly 46 moves into engagement with a stop member 200 which positions the bearing assembly relative to the carriage 194 and pusher 196. The stop member 200 is releasably mounted on a support structure 204 to enable different size stop members to be utilized for different size bearing assemblies 46.

Once a bearing assembly 46 has been moved to one of the receiving locations 86, 90, 92, 94 or 96 (FIG. 3) on the turntable 160 by the loader assembly 84, the turntable is indexed through 60°. This moves the bearing assembly 46 to the next succeeding station, that is the coating station 102 (FIG. 3). Indexing the turntable 160 also moves a next succeeding empty receiving location to the loading station 82. Thus, after the bearing assembly 46 has been pushed into the receiving location 86 by the loader assembly 84 (FIG. 4), the turntable 160 is indexed through 60° about a vertical central axis. This moves the receiving location 86 into the first coating station 102 and moves the next succeeding receiving location 96 into the loading station 82.

First Coating Station

Figure 6:
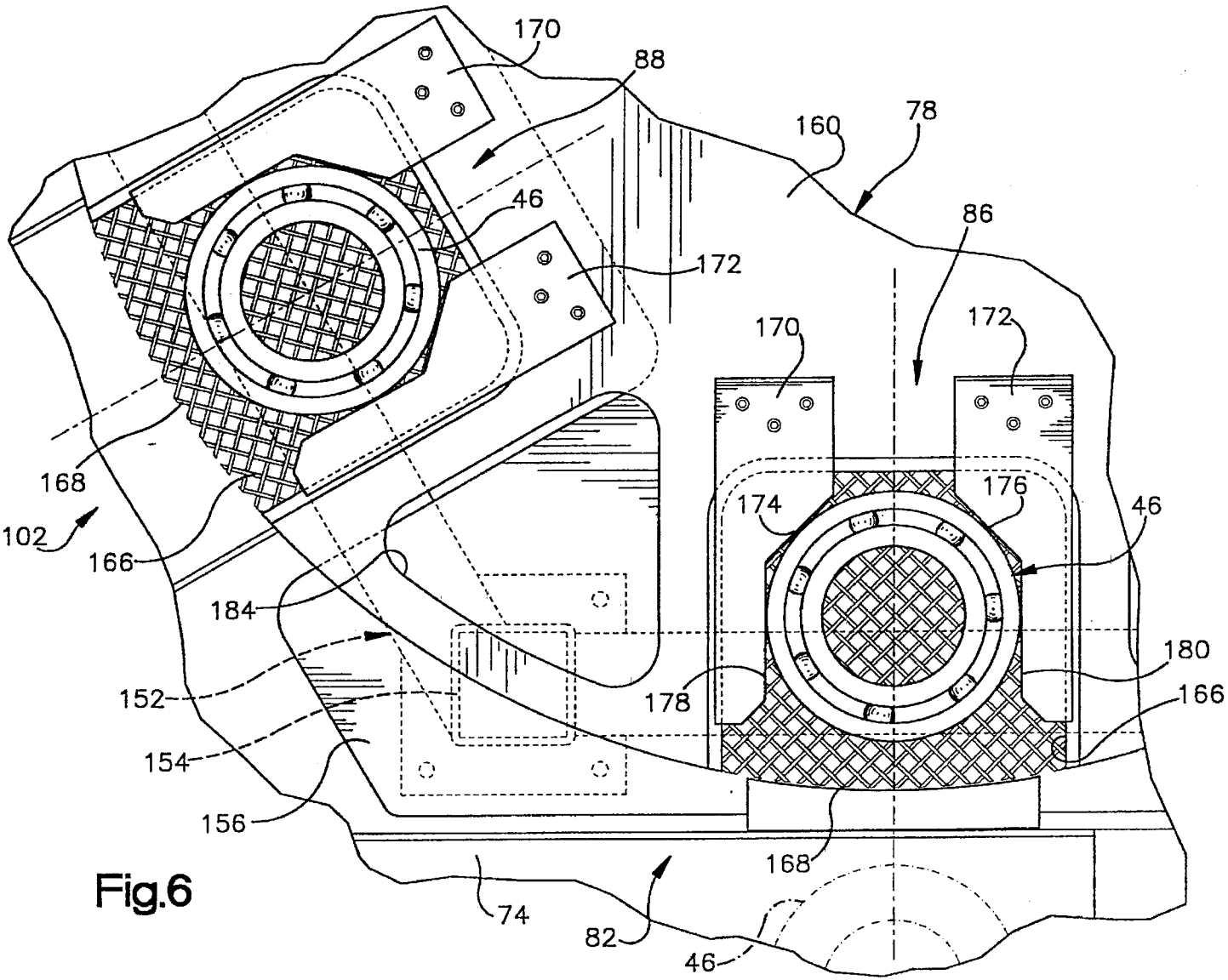
FIG. 6 is an enlarged plan view of a bearing assembly receiving location on a conveyor in the automated coating system.

At the first coating station 102 (FIG. 3), the coating apparatus 104 is operable to sequentially apply coating material to the bearing assemblies 46. At this time, the end surfaces 64 and 68 (FIG. 2) on the outer and inner races 48 and 50 of the bearing assembly face upward. The opposite end surfaces 66 and 70 on the outer and inner races 48 and 50 of the bearing assembly 46 at the receiving location 88 engage the horizontal support screen 168 (FIGS. 3 and 6). The openings in the support screen 168 enable coating material which does not adhere to the bearing assembly 46 to move through the receiving location 88.

The coating apparatus 104 (FIGS. 7 and 8) includes a housing 210 (FIG. 7) in which a chamber 212 is disposed. The housing 210 extends from a level below the turntable 160 to a level above the turntable. A lower end of the chamber 212 is formed by the turntable 160. Therefore, the chamber 212 is disposed above the turntable 160.

Figure 7:
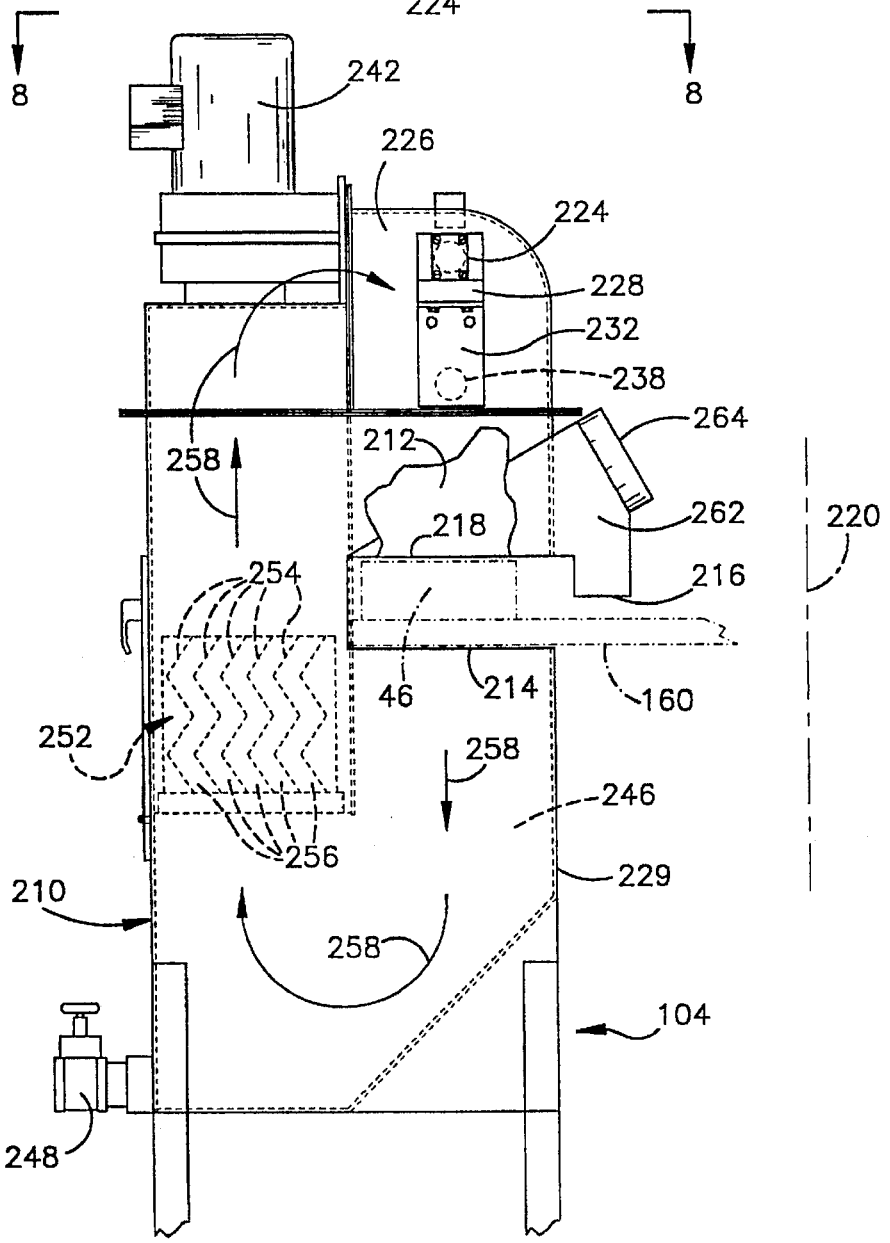
FIG. 7 is a side elevational view, taken generally along the line 7—7 of FIG. 3, illustrating a coating apparatus located at a coating station.

The housing 210 has horizontal side openings or slots 214, 216 and 218 through which the turntable 160 extends (FIG. 7). The slots 214 and 218 are disposed in opposite side walls 225 and 226 (FIG. 8) of the housing 210 and have sufficient height to enable a bearing assembly 46 to move through the slots along with the turntable 160 (FIG. 7). However, the slot 216 is formed in a front side wall 229 (FIG. 7) of the housing 210 and has a relatively short height. This is because the bearings assemblies 46 do not pass through the slot 216 as the turntable 160 rotates about its vertical central axis, indicated schematically at 220 in FIG. 7.

A coating material flow control apparatus 224 is mounted on a side wall 226 of the housing 210. The coating material flow control apparatus 224 directs a flow of a coating material and compressed fluid mixture into the chamber 212. Although it is preferred to mount the coating material flow control apparatus 224 outside the chamber 212, the coating material flow control apparatus could be mounted inside the chamber if desired.

The coating material flow control apparatus 224 and the mixture of coating material and compressed fluid conducted through the coating material flow control apparatus are heated by a heater 228 (FIG. 7). The heater 228 is disposed directly beneath the coating material flow control apparatus. The heater 228 and coating material flow control apparatus 224 are mounted on a bracket 232. The orientation of the bracket 232 can be changed to lower the coating material flow control apparatus 224 from the position shown in solid lines in FIG. 7 to a position indicated schematically by dashed lines at 238 in FIG. 7.

When the coating material flow control apparatus 224 is to be lowered relative to the chamber 212 and turntable 160, the bracket 232, with the coating material flow control apparatus 224 and heater 228 mounted thereon, is merely rotated through 180° from the position shown in FIG. 7. This results in the coating material flow control apparatus 224 being moved to the position indicated in dashed lines at 238 in FIG. 7. Since the heater 228 is mounted on the bracket 232 along with the coating material flow control apparatus 224, the heater is lowered along with the coating material flow control apparatus when the bracket 232 is rotated through 180°.

In the illustrated embodiment of the invention, the coating material flow control apparatus 224 is a spray gun which is periodically actuated to direct a spray of the coating material and compressed fluid mixture into the chamber 212. The spray gun forming the coating material flow control apparatus 224 could have many different constructions. However, it is preferred to construct the spray gun in the manner disclosed in U.S. Pat. No. 5,088,443 issued Feb. 18, 1992 and entitled "Method and Apparatus for Spraying a Liquid Coating Containing Supercritical Fluid or Liquified Gas". The disclosure in the aforementioned U.S. Pat. No. 5,088,443 is hereby incorporated herein in its entirety by this reference thereto. However, it should be understood that, if desired, the coating material flow control apparatus 224 could have a construction which is different from the construction disclosed in the aforementioned U.S. patent.

When the coating material and compressed fluid mixture is directed into the chamber 212 by the coating material flow control apparatus 224, the compressed fluid immediately expands or flashes off in the relatively low pressure environment of the chamber 212. As this occurs, the rapidly expanding fluid atomizes the coating material to form many fine particles of coating material. The fine particles of coating material result in the formation of an aerosol of coating material in the chamber 212.

A fan assembly 242 (FIG. 7) induces a current of air to flow downward in the chamber 212. The downward flow of air in the chamber 212 moves the aerosol containing fine particles of coating material downward onto the bearing assembly 46 supported in the chamber 212 on the turntable 160. The flow of air is conducted around the bearing assembly 46 and leaves the chamber 212 through the support mesh or screen 168 (FIG. 6) upon which the bearing assembly is supported. As this occurs, many of the fine particles of coating material are deposited on exposed surface areas of the bearing assembly 46.

The flow of air from the fan assembly 242 (FIG. 7) is conducted from the chamber 212 into a tank 246 disposed immediately beneath the chamber 212 and the bearing assembly 46. This results in excess coating material being deposited in the tank 246. An outlet 248 from the tank 246 enables the excess coating material to be recovered and reused or disposed of in a suitable manner.

The flow of air is conducted upward from the tank 246 through a baffle assembly 252. The baffle assembly 252 includes a plurality of zigzag or corrugated plates 254 which form non-linear or zigzag flow paths 256 along which the flow of air, with fine particles of coating material disposed therein, is conducted. As the air flows along the zigzag paths 256 in the baffle assembly 252, droplets of coating material are deposited on the baffle plates 254. These droplets of coating material flow downward into the tank 246.

The flow of air is conducted upward from the baffle assembly 252 back to the fan assembly 242. A very fine mist of coating material particles is disposed in the flow of air conducted from the baffle assembly 252 to the fan assembly 242. This fine mist of coating material particles is recirculated through the chamber 212. The fan assembly 242 is effective to cause a circuitous air flow through the chamber 212, tank 246, and baffle assembly 252 in the manner indicated by the arrows 258 in FIG. 7.

There may be some tendency for the air flow from the fan assembly 242 to cause the aerosol of fine particles of coating material to flow out of the housing 210 through the slots 214 and 218 through which the turntable 160 moves the bearing assembly 46, and to a lesser extent, through the slot 216 through which the turntable extends. To prevent coating material particles from being conducted to the environment around the coating apparatus 104, a hood assembly 262 is connected with the outside of the housing 210 and is disposed immediately above the slots 216 and 218. The hood assembly 262 has an outlet 264 (FIG. 8) which is connected with a fan which reduces the pressure within the hood assembly 262. This results in any coating particles which may tend to escape from the housing 210 being drawn into the hood assembly 262 and conducted to a suitable receiving location.

After the bearing assembly 46 at the receiving location 88 (FIG. 3) has been exposed to the aerosol containing the fine particles of coating material, the turntable 160 is indexed to move the receiving location 88 to the turning station 108. As the turntable 160 is rotated in a clockwise direction (as viewed in FIG. 3), the opening 184 between the loading station 82 and the first coating station 102 enters the coating apparatus 104. The opening 184 in the turntable 160 enables the flow of air from the fan assembly 242 to pass through the turntable. In the absence of the opening 184 in the turntable, there would tend to be an increase in the pressure in the chamber 212. However, the opening 184 in the turntable enables the air to pass through the turntable and minimizes fluctuations in the fluid pressure in the chamber 212 during rotation of the turntable 160.

Turning Station

At the turning station 108, a bearing assembly 46 which had been previously been coated at the coating station 102, is turned over. Thus, when a bearing assembly 46 (FIG. 2) is coated at the first coating station 102, the end surfaces 64 and 68 on the outer and inner races 48 and 50 face upward and the end surfaces 66 and 70 on the races face downward. At the turning station 108, the bearing assembly is turned over so that the end surfaces 66 and 70 on the races 48 and 50 face upward and the end surfaces 64 and 68 face downward.

The turning apparatus 110 (FIGS. 3 and 9) at the turning station 108 is operable to grip the bearing assembly 46 at the receiving location 90 when the turntable 160 is in the position shown in FIG. 3. The turning apparatus 110 then raises the bearing assembly 46 and rotates the bearing assembly about a horizontal axis which extends perpendicular to and intersects a central axis of the bearing assembly and the central axis of the turntable 160. The turning apparatus 110 then lowers the turned over bearing assembly 46 back onto the turntable 160.

The turning apparatus 110 includes a gripper assembly 270. A gripper lift assembly 272 (FIG. 9) is operable to raise and lower the gripper assembly 272. The gripper lift assembly 272 includes a piston and cylinder type motor 274 which is connected with the gripper assembly 270. The gripper lift assembly 272 supports the gripper assembly 270 in a raised initial or parked position above the turntable 160 (FIG. 9).

Upon operation of the gripper lift assembly 272 to lower the gripper assembly 270, a pair of grippers 278 and 280 (FIG. 3) are moved downward along a vertical path into radial alignment with the bearing assembly 46 at the receiving location 90. A gripper actuation motor 282 is then operated to move the grippers 278 and 280 toward each other along horizontal paths. The grippers 278 and 280 move into engagement with the outer race 48 of the bearing assembly 46. The gripper actuator motor 282 is a known piston and cylinder type motor.

Once the grippers 278 and 280 have been moved into engagement with the bearing assembly 46 at the receiving location 90 by the gripper actuator motor 282, the gripper lift assembly 272 (FIG. 9) is operated to raise the gripper assembly 270. As this occurs, the bearing assembly 46 is moved straight upward from the position shown in dashed lines in FIG. 9 to the position shown in solid lines in FIG. 9. Thus, the bearing assembly 46 is lifted vertically upward off of the support screen 168 at the receiving location 90 on the turntable 160.

Once the gripper assembly 270 and bearing assembly 46 have been moved to the raised position shown in solid lines in FIG. 9, a rotator motor 286 (FIGS. 3 and 9) is operated to turn the gripper assembly 270 and the bearing assembly 46 over. The rotator motor 286 is a piston and cylinder type motor having a piston connected with a rack gear. The rack gear is disposed in meshing engagement with a pinion connected with the gripper assembly 270.

Upon operation of the rotator motor 286, the rack gear rotates the pinion. Rotation of the pinion turns over the gripper assembly 270 and the bearing assembly 46 held by the gripper assembly. The gripper assembly 270 and the bearing assembly 46 are turned over by rotating them through 180° about a horizontal axis. The horizontal axis about which the gripper assembly 270 and bearing assembly 46 are rotated extends through the bearing assembly and is perpendicular to and intersects the central axis of the bearing assembly and the vertical central axis 220 about which the turntable 160 is rotated.

Once the gripper assembly 270 and bearing assembly have been turned over, the gripper lift assembly 272 is operated to lower the gripper assembly 270. This moves the bearing assembly 46 back to the receiving location 90 on the turntable 160. When the bearing assembly 46 is returned to the turntable 160, the bearing assembly will have been rotated through 180° from its original position so that the formerly upper side of the bearing assembly now faces downward and the formerly downward side now faces upward. Thus, the end surfaces 64 and 68 on the inner and outer races 48 and 50 faced upward during coating of the bearing assembly 46 at the first coating station 102 (FIG. 3). After the bearing assembly 46 has been turned over by operation of the turning apparatus 110, the end surfaces 66 and 70 on the inner and outer races 48 and 50 face upward.

Once the bearing assembly 46 has been turned over and returned to the receiving location 90 on the turntable 160 by the turning apparatus 110, the gripper actuator motor 282 is operated to move the grippers 278 and 280 (FIG. 3) away from the bearing assembly 46. The gripper lift assembly 272 (FIG. 9) is then operated to raise the open gripper assembly 270 to a position in which the gripper assembly is above the turntable 160. The gripper assembly 270 remains in this position until the next succeeding bearing assembly 46 has been moved to the turning station 108 by the turntable 160.

The rotator motor 286 is operable to rotate the gripper assembly 270 in one direction about a horizontal axis to turn over a first bearing assembly. The rotator motor 286 subsequently rotates the gripper assembly 270 and a next succeeding bearing assembly in the opposite direction. Thus, the piston and cylinder type rotator motor 286 is operated to one end of stroke position during turning over of one bearing assembly 46 and is operated to the opposite end of stroke position during turning over of a next succeeding bearing assembly. However, each of the bearing assemblies 46 is rotated through 180° to turn the bearing assembly over.

Second Coating Station

After a bearing assembly 46 has been turned over at the turning station 108 (FIG. 3), the bearing assembly is moved to the second coating station 114 by indexing movement of the turntable 160. At the second coating station 114, coating material is applied to the bearing assembly by the coating apparatus 116 while the flat end surfaces 66 and 70 (FIG. 2) on the outer and inner races 48 and 50 of the bearing assembly face upward. Thus, at the first coating station 102 (FIG. 3), the coating apparatus 104 is effective to apply coating material to a bearing assembly with the end surfaces 64 and 68 on the outer and inner races 48 and 50 facing upward. At the second coating station 114, the coating apparatus 116 is effective to apply coating material to the bearing assembly with the end surfaces 66 and 70 on the outer and inner races 48 and 50 facing upward.

The coating apparatus 116 (FIG. 3) at the second coating station 114 has the same construction and mode of operation as the coating apparatus 104 at the first coating station 102. Thus, the coating apparatus 116 at the coating station 114 includes a housing 292 having the same construction as the housing 210 of FIG. 7. The bearing assembly 46 at the receiving location 92 is disposed in a chamber in the housing 292 in the same manner as in which a bearing assembly is disposed in the chamber 212 of the housing 210 of FIG. 7.

A coating material flow control apparatus (not shown) having the same construction as the coating material flow control apparatus 224 of FIG. 7 is connected to an outer side wall of the housing 292 (FIG. 3). The coating material flow control apparatus connected with the housing 292 at the second coating station 114 is effective to dispense a mixture of coating material and compressed fluid into the chamber in the housing 292. This results in the formation of an aerosol of fine coating material particles in the chamber of the housing 292 in the same manner as previously explained in conjunction with the coating apparatus 104 of FIGS. 7 and 8.

A fan assembly connected with the housing 292 induces a downward flow of air in the chamber in the housing so that the fine particles of coating material in the aerosol are moved into engagement with the bearing assembly. Once the coating material has been applied to the bearing assembly 46 at the second coating station 114, the turntable 160 is indexed to move the bearing assembly to the rotating station 120.

Rotating Station

An even distribution of the coating material over the ball bearings 62 (FIG. 2) in the bearing assembly 46 and along the inner side surface 54 of the outer race 48 and the outer side surface 56 of the inner race 50 is promoted by providing relative rotation between the inner and outer races 48 and 50 of the bearing assembly 46. This relative rotation between the outer and inner races 48 and 50 occurs at the rotating station 120 (FIG. 3) after the coating material has been applied to the bearing assembly 46 at the first coating station 102 and the second coating station 104. The rotating apparatus 124 at the rotating station 120 is operable to rotate the inner race 50 of the bearing assembly 46 relative to the outer race 48. Although it is preferred to rotate the inner race 50 relative to the outer race 48, the outer race could be rotated relative to the inner race 50 if desired.

The rotating apparatus 124 (FIGS. 3, 9, 10 and 11) includes a gripper assembly 300 (FIG. 10). A gripper lift assembly 302 (FIG. 9) is connected with the gripper assembly 300. The gripper lift assembly 302 includes a piston and cylinder type motor 304 which is operable to lower the gripper assembly 300 vertically downward from the raised initial position shown in FIG. 9. When the gripper assembly 300 has been lowered, the grippers 308 and 310 (FIG. 10) in the gripper assembly 300 will have moved into radial alignment with the bearing assembly 46 at the receiving location 94.

A gripper actuator motor 312 (FIG. 10) is then operated to move the grippers 308 and 310 into engagement with opposite sides of the outer race 48 of the bearing assembly 46 at the rotating station 120. Thus, operation of the gripper actuator motor 312 moves the grippers 308 and 310 toward each other along horizontal paths which extend parallel to the upper side of the turntable 160. The piston and cylinder type gripper motor 312 operates the gripper assembly 300 in the same manner as in which the gripper actuator motor 282 operates the gripper assembly 270 at the turning station 108 (FIG. 3).

Once the bearing assembly 46 at the rotating station 120 (FIG. 10) has been engaged by the grippers 308 and 310, the gripper lift assembly 302 (FIG. 9) is operated. Operation of the gripper lift assembly 302 moves the gripper assembly 300 and the bearing assembly 46 vertically upward to the position shown in solid lines in FIG. 9. As the bearing assembly 46 is moved upward, the bearing assembly moves toward a rotational force transmitting assembly 318 (FIGS. 9 and 11).

At this time, a piston and cylinder type actuator motor 320 in the force transmitting assembly 318 (FIG. 11) is in a retracted condition. Therefore, movable sections 322 and 324 are disposed in abutting engagement with a motor cylinder block 326 (FIG. 11). Downwardly extending cylindrical force transmitting members 330 and 332 are in the positions shown in dashed lines in FIG. 11.

Figure 11:
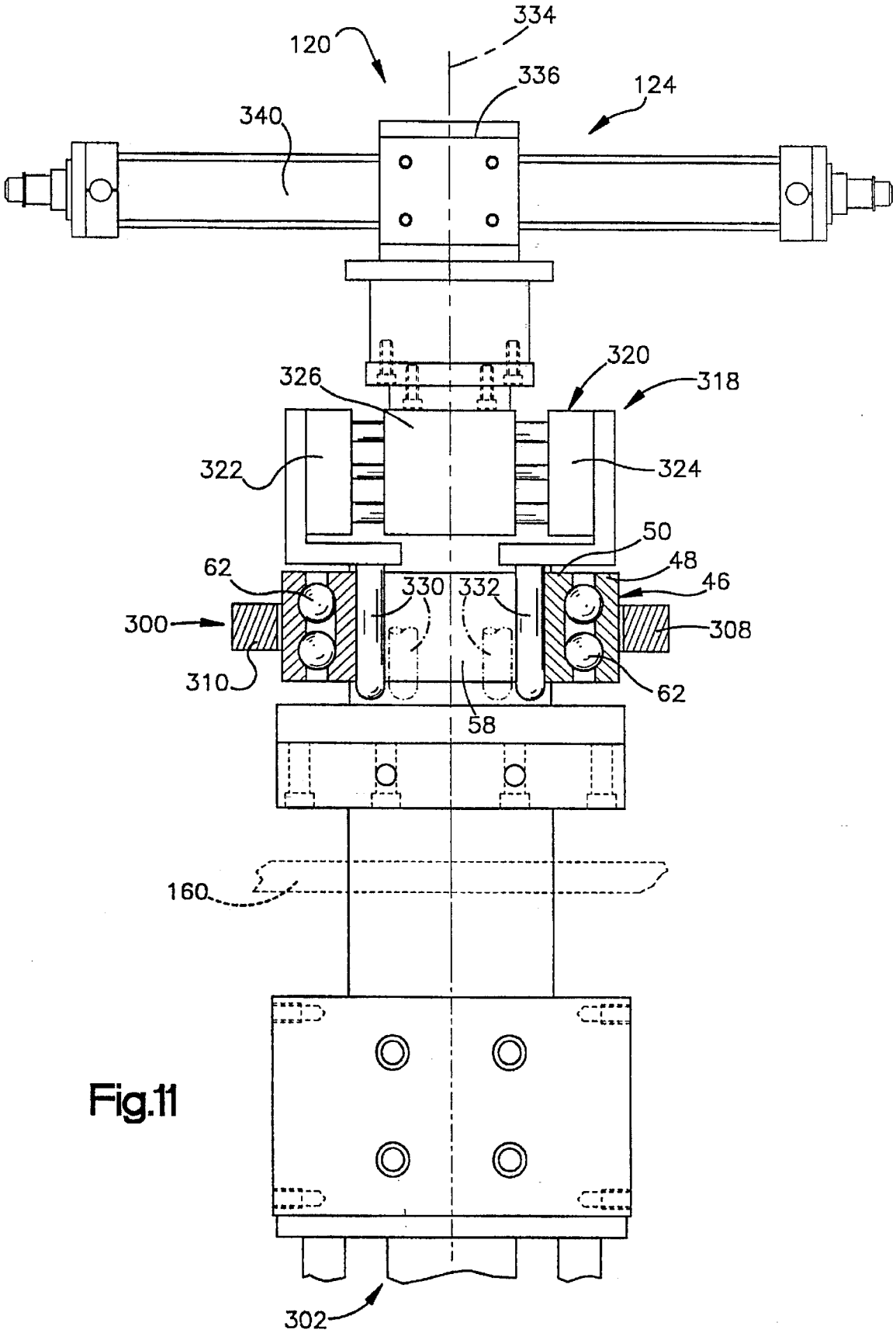
FIG. 11 is an enlarged fragmentary elevational view, taken generally along the line 11—11 of FIG. 9, further illustrating the apparatus at the rotating station.

The force transmitting members 330 and 332 are relatively close together, as shown in dashed lines in FIG. 11. Therefore, the bearing assembly 46 can be readily moved to a position in which the force transmitting members 330 and 332 extend into the open central portion of the inner race 50 of the bearing assembly. At this time, the cylindrical outer side surfaces of the force transmitting members 330 and 332 are spaced from the cylindrical inner side 58 of the inner bearing race 50. Central axes of the force transmitting members 330 and 332 extend parallel to a vertical central axis 334 of the force transmitting assembly 318.

Once the gripper assembly 300 and the bearing assembly 46 have been moved to the raised position shown in FIG. 11 by the gripper lift assembly 302 (FIG. 9), the actuator motor 320 (FIG. 11) is operated to move the motor sections 322 and 324 away from each other. As this occurs, the force transmitting members 330 and 332 are moved apart to the positions shown in solid lines in FIG. 11. As this occurs, the force transmitting members 330 and 332 move into tight abutting engagement with the cylindrical inner side surface 58 on the inner race 50 of the bearing assembly 46.

After the force transmitting members 330 and 332 have moved into engagement with the inner race 50 of the bearing assembly 46 (FIG. 11), a rotator assembly 336 is operated to rotate the force transmitting assembly 318 about the axis 334. The vertical axis 334 is coincident with a central axis of the bearing assembly 46. The vertical central axis 334 of the force transmitting assembly 318 is disposed in a vertical plane which extends radially through the turntable 160 and contains the vertical central axis 220 of the turntable (FIG. 9).

While the rotator assembly 336 rotates the force transmitting assembly 318, the gripper assembly 300 holds the outer race 48 against rotation. Rotation of the force transmitting assembly 318 results in the inner race 50 of the bearing assembly 46 being rotated by the force transmitting members 330 and 332. If desired, the outer race 48 could be rotated relative to the inner race 50.

As the inner race 50 is rotated relative to the stationary outer race 48 by the force transmitting assembly 318, the ball bearings 62 roll along the inner side surface 54 (FIG. 2) of the stationary outer race 48 and the outer side surface 56 of the inner race 50. This promotes an even distribution of the coating material on the ball bearings 62 and on the surfaces of the inner and outer races 48 and 50.

The rotator assembly 336 includes a piston and cylinder type motor 340 (FIG. 11). A rack gear is connected with the piston of the piston and cylinder motor 340. A pinion is disposed in meshing engagement with the rack gear and is connected with the force transmitting assembly 318. Therefore, upon operation of the motor 340 to move the rack gear, the pinion is rotated to rotate the force transmitting assembly 318 about the vertical axis 334.

The direction of operation of the motor 340 in the rotator assembly 336 can be reversed to reverse the direction of rotation of the force transmitting assembly 318 and the inner race 50 of the bearing assembly 46. Thus, the motor 340 is operable to move the rack gear in one direction to rotate the inner race 50 of the bearing assembly 46 through one complete revolution (360°) in one direction, for example, counterclockwise. Upon reversal of the operation of the motor 340 in the rotator assembly 336, the direction of movement of the rack gear and the direction of rotation of the force transmitting assembly 318 is reversed. This results in rotation of the inner race 50 through one complete revolution in the opposite direction, that is, clockwise. The direction of operation of the motor 340 in the rotator assembly 336 is reversed for each bearing assembly 46 to thereby oscillate the inner race 50 through one complete revolution in each direction relative to the stationary outer race 48.

Once the inner race 50 has been oscillated relative to the stationary outer race 48 of the bearing assembly 46, the actuator motor 320 in the force transmitting assembly 318 is operated to move the sections 322 and 324 (FIG. 11) into engagement with the cylinder block 326. This moves the force transmitting members 330 and 332 out of engagement with the inner race 50 and back to the initial position shown in dashed lines in FIG. 11. The gripper lift assembly 302 (FIG. 9) is then operated to lower the gripper assembly 300.

As the gripper assembly 300 is lowered, the bearing assembly 46 is moved from the position shown in solid lines in FIG. 9 back to the position shown in dashed lines in FIG. 9. When the gripper assembly 300 has moved the bearing assembly 46 back to the position shown in dashed lines in FIG. 9, the bearing assembly will be disposed in engagement with the mesh 168 at the receiving location 94. The gripper actuator motor 312 (FIG. 10) is then operated to move the grippers 308 and 310 away from the bearing assembly 46.

The gripper lift assembly 302 (FIG. 9) is then operated to raise the gripper assembly 300 upward to a position in which it is disposed above the bearing assembly 46 at the receiving location 94. The turntable 160 can then be indexed to move the bearing assembly 46 from the rotation station 120 to the unloading station 128.

In the illustrated embodiment of the invention, the inner race 50 is rotated relative to the outer race 48 by a pair of force transmitting members 330 and 332. However, a single force transmitting member could be used to rotate either the outer race 48 or the inner race 50. In one embodiment of the invention, a conical drive member is moved into engagement with the inner race 50 and rotated about coincident central axes of the inner race and conical drive member. It is contemplated that a circular drive wheel could be moved into engagement with the outer race 48 and rotated to rotate the outer race while the inner race 50 is stationary.

Unloading Station

At the unloading station 128 (FIGS. 3 and 12), a bearing assembly 46 is moved off of the turntable 160 onto the outfeed conveyor 76. The unloader assembly 130 includes a piston and cylinder type motor 344 (FIG. 12) which is supported on a horizontal beam 346. The beam 346 and unloader motor 344 have parallel horizontal longitudinal axes which intersect the vertical central axis of the rotary conveyor 78. The longitudinal axes of the beam 192 and motor 190 are disposed in a vertical plane which extends radially through the turntable 160.

The unloader motor 344 is connected with a carriage 350 (FIG. 12). A pusher member 352 is connected with the carriage 350. Operation of the motor 344 moves the carriage 350 toward the right (as viewed in FIG. 12). As this occurs, the pusher member 352 moves into engagement with the bearing assembly 46 and pushes the bearing assembly 46 down a ramp 356 to the outfeed conveyor 76.

Guide members 358 and 360 (FIG. 3) are disposed at the unloading station 128 to guide movement of the bearing assembly 46 from the receiving location 96 to the outfeed conveyor 76. The construction of the unloader assembly 130 is generally the same as the construction of the loader assembly 84. However, the unloader assembly 130 is operated to push bearing assemblies 46 off of the turntable 160 while the loader assembly 84 is operated to push bearing assemblies onto the turntable.

Once a bearing assembly 46 has been pushed onto the outfeed conveyor 76 by the unloader assembly 130, the direction of operation of the unloader motor 344 (FIG. 12) is reversed to move the carriage 350 leftward (as viewed in FIG. 12) back to a position where it is disposed radially inwardly of the receiving location 96 on the turntable 130. The outfeed conveyor 76 moves each of the bearing assemblies 46 in turn to a remote location for further processing. The turntable 160 is indexed to move the empty receiving location 96 to the loading station 82 and to move the next succeeding receiving location 94 to the unloading station 128.

Mixer System

The coating material flow control apparatus at the first and second coating stations 102 and 114 are supplied with a mixture of coating material and compressed fluid by the mixer system 134 (FIG. 13). In the illustrated embodiment of the invention, the liquid coating material is a corrosion preventative which is commercially available from Quaker Chemical Corporation, having a place of business at Coshocken, Pa. However, it should be understood that other coating materials could be utilized if desired.

In the illustrated embodiment of the invention, the compressed fluid is carbon dioxide. The carbon dioxide is maintained at a pressure and temperature such that it has a density which is at least approaching that of a liquid. The compressed fluid could be a liquified gas other than carbon dioxide. It should be understood that the gas does not have to be in a pure liquified condition. The gas may only be in a condition which is close to a liquified condition. Thus, the temperature and/or pressure of the gas may not be sufficient to cause the gas to liquify.

The liquid coating material is conducted to an inlet 370 (FIG. 13) to the mixer system 134. The liquid coating material is directed through a three-way valve 372 to a conduit 374. The liquid coating material is conducted through a check valve 376 to a flow meter 378. The rate of flow of the liquid coating material is measured by the flow meter 378.

The liquid coating material is conducted from the flow meter 378 through a check valve 380 to a three-way control valve 382. The liquid coating material is conducted from the three-way valve 382 to a conduit 384. The coating material is conducted through a standby valve 386 to a junction 388.

A pneumatic actuator 392 is connected with the standby valve 386. In the event that the mixer system 134 is not to be utilized for a period of time, air pressure is conducted through an inlet 394 to effect operation of the actuator 392. Operation of the actuator 392 closes the standby valve 386 until the mixer system 134 is to again be activated.

Compressed fluid, such as carbon dioxide, is conducted from an inlet 398 through a three-way valve 400. The carbon dioxide is advantageously at a pressure and temperature which exceeds the supercritical temperature and pressure for the carbon dioxide. The compressed carbon dioxide is conducted from the three-way valve 400 to a conduit 402 which is connected with a mass flow meter 404 through a check valve 406. The output from the mass flow meter 404 is conducted through a check valve 408 to a three-way valve 410.

The output from the three-way valve 410 is conducted through a flow control valve 414. The flow control valve 414 is pulsed by an actuator 416 to provide a desired compressed fluid flow rate. The actuator 416 is connected with a suitable control, which includes an electrical pulse generator, through the terminal 420.

The compressed fluid flows from the flow control valve 414 to a two-way valve 424. The flow of compressed fluid is conducted through a standby valve 426 to a three-way valve 428. A pneumatic actuator 432 is connected with the standby valve 426 and is operated by air pressure conducted from the inlet 394 to close the standby valve when the mixer system 134 is not to be used for a period of time.

The compressed fluid is conducted from the three-way valve 428 through a check valve 436 to the junction 388. At the junction 388, the flow of compressed fluid is combined with the flow of coating material and is conducted to a mixer 440. The mixer 440 is operable to thoroughly mix the compressed fluid with the coating material. The mixture of compressed fluid and coating material is conducted from the mixer 440 to a three-way valve 444.

Assuming that the mixture of compressed fluid and coating material is to be utilized by the automated coating system 44, the mixture of compressed fluid and coating material is conducted through an outlet 446. However, if for some unforeseen reason it is decided that the mixture of compressed fluid and coating material is not to be utilized, a pneumatic actuator 450 may be operated by air pressure conducted from an inlet 452 to the pneumatic actuator. Operation of the pneumatic actuator operates the three-way valve 444 to direct the mixture of coating material and fresh fluid to a dump outlet 456.

A solvent inlet 460 is connected with a source of solvent. When the components of the mixer system 134 are to be cleaned, solvent is conducted from the inlet 460 through the various components of the mixer system to clean these components.

The mixer system 134 has a known construction and mode of operation. The mixer system 134 corresponds to mixer systems constructed by Union Carbide Chemicals and Plastics Technology of Danbury, Conn. for use with the "Unicarb" (trademark) process. The "Unicarb" (trademark) process utilizes supercritical carbon dioxide as the compressed fluid. However, it is contemplated that the compressed fluid may not be in a true supercritical condition and that fluids other than carbon dioxide may be used.

Combined Automated Coating System

The mixer system 134 of FIG. 13 forms a portion of the combined automated coating system 138 of FIG. 14. The combined automated coating system 138 may include only a single automated coating system 44 (FIG. 3). However, in the illustrated (FIG. 14) embodiment of the invention, the combined automated coating system 138 includes a plurality of automated coating systems 44. In one specific embodiment of the combined automated coating system 138, there were eight automated coating systems 44.

The mixer system 134 is supplied with coating material by a pump 466 (FIG. 14). The mixer system 134 is supplied with compressed fluid (carbon dioxide) from a source 470. The outlet 446 from the mixer system 134 is connected with the accumulator 142.

The mixer system 134 supplies a mixture of coating material and compressed fluid to the accumulator 142. The flow rate at which the mixture of coating material and compressed fluid is supplied by the mixer system 134 is substantially greater than the rate at which the mixture of coating material and compressed fluid is utilized by the combined automated coating system 138. Therefore, a supply of the mixture of coating material and compressed fluid is held in a container 472 in the accumulator 142.

The supply of the mixture of coating material and compressed fluid is maintained under pressure in the container 472 by an expansion chamber in an accumulator 476. In the illustrated embodiment of the invention, the container 472 is provided with a heater 480 to heat the mixture of coating material and compressed fluid in the container 472. If desired, the heater 480 could be omitted.

A pump 484 is operable to pump the mixture of coating material and compressed fluid through a valve 486 to an in-line heater 488. The heated mixture of coating material and compressed fluid is conducted from the heater 488 to the first automated coating system 44 through a conduit 492 which forms a portion of the manifold loop 144. If desired, the heater 488 could be omitted.

The conduit 492 in the manifold loop 144 conducts the mixture of coating material and compressed fluid to the coating material flow control apparatus 224 at the first coating station 102 in the first automated coating system 44. The conduit 494 conducts the mixture of coating material and compressed fluid to a coating material flow control apparatus 498 at the second coating station 114. The coating material flow control apparatus 498 has the same construction and mode of operation as the coating material flow control apparatus 224.

A conduit 500 conducts the mixture of coating material and compressed fluid from the second coating station 114 in the first automated coating system 44 to a next succeeding automated coating system 44. The manifold loop 144 conducts the mixture of coating material and compressed fluid to each of the automated coating systems 44 in the combined automated coating system 138. Additional in-line heaters, corresponding to the in-line heater 488, may be provided in the manifold loop 144.

The number of automated coating systems 44 in the combined automated coating system 138 depends upon the rate at which bearing assemblies are to be coated. In each of the automated coating systems 44, coating material flow control assemblies 224 and 498 at the first coating station 102 and second coating station 114 have regulators 128 through which the mixture of coating material and compressed fluid is conducted. The regulators have the same construction as is disclosed in the aforementioned U.S. Pat. No. 5,088,443.

A solvent pump 510 is connected with the manifold loop 144 through a supply conduit 512. A branch line 514 connects the supply conduit 512 with the three-way valve 486. Similarly, branch conduits 516 connect the solvent supply conduit 512 with valves 518 connected with the manifold loop 144.

Second Embodiment

Figure 8:
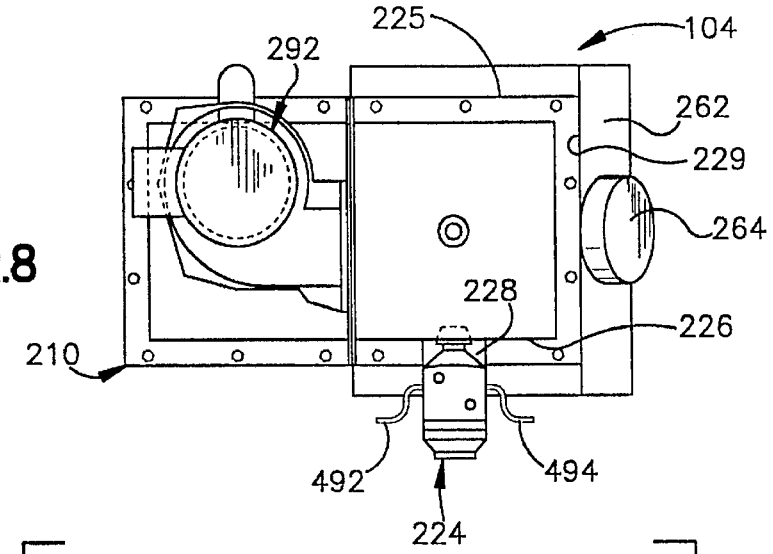
FIG. 8 is a plan view, taken generally along the line 8—8 of FIG. 7, further illustrating the construction of the coating apparatus.
Figure 15:
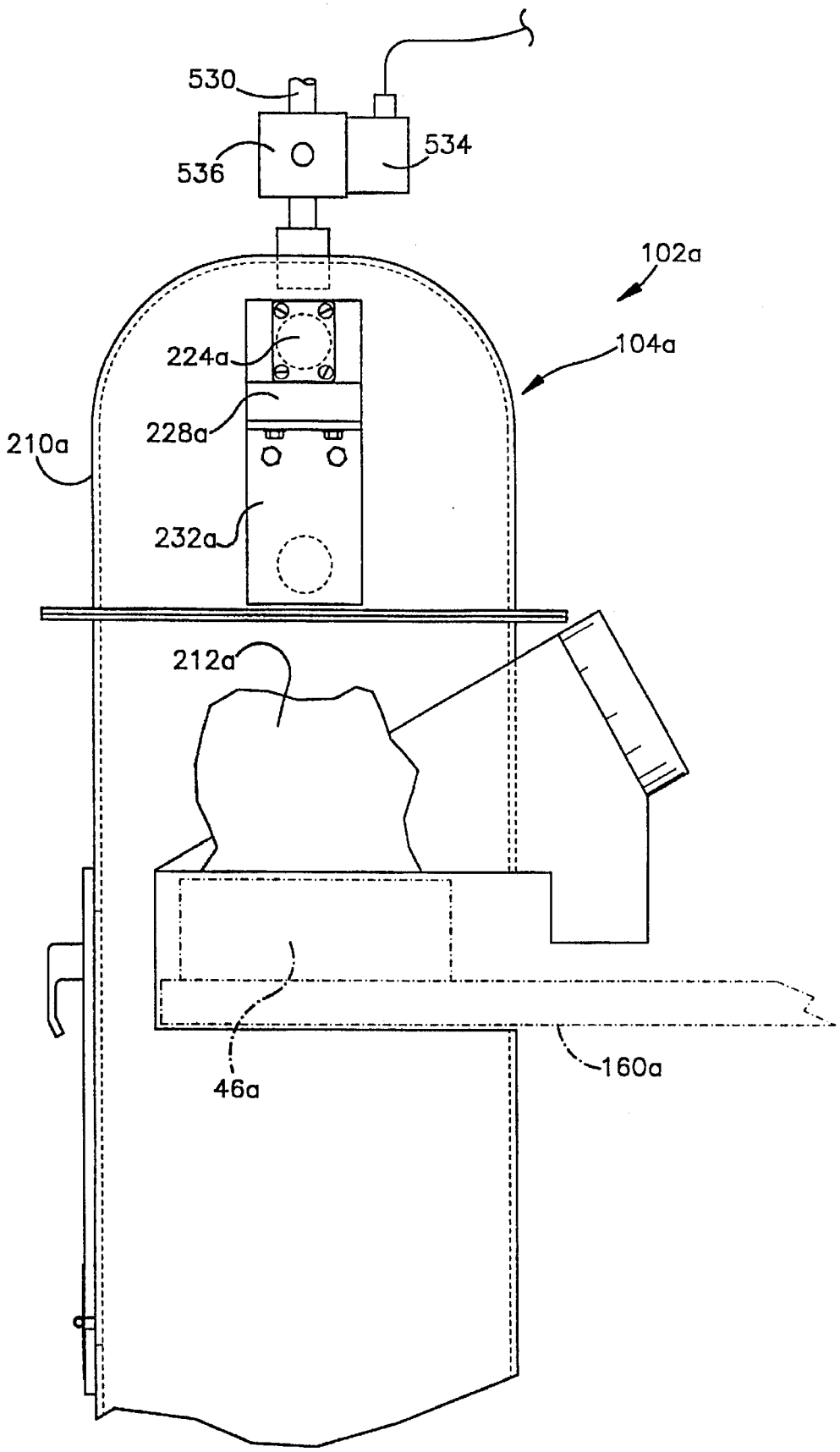
FIG. 15 is a side elevational view, generally similar to FIG. 7, illustrating a second embodiment of the coating apparatus.

In the embodiment of the invention illustrated in FIGS. 7 and 8, a fan assembly 242 is operable to supply a continuous circuitous flow of air, indicated by the arrows 258 in FIG. 7. However, it is contemplated that an intermittent supply of air may be utilized to direct a flow of the aerosol of fine coating material particles downward onto a bearing assembly at the first coating station 102 and/or the second coating station 114. In the embodiment of the invention illustrated in FIG. 15, an intermittent supply of air is utilized. Since the embodiment of the invention illustrated in FIG. 15 is generally similar to the embodiment of the invention illustrated in FIG. 7, similar numerals will be utilized to designate similar components, the suffix letter "a" being associated with the numerals of FIG. 15 to avoid confusion.

A housing 210*a* in a coating apparatus 104*a* at the first coating station 102*a* is connected with a supply of air through a conduit 530. A coating material flow control apparatus 224*a* is mounted on a side wall of the housing 210*a* by a bracket 232*a*. The bracket 232*a* supports the coating material flow control apparatus 224*a* and a heater 228*a*.

As the coating material flow control assembly 224*a* dispenses a mixture of coating material and compressed fluid into a chamber 212*a* in the housing 210*a*, a solenoid 534 is energized to actuate an air flow control valve 536 to an open condition. Actuation of the air flow control valve 536 to an open condition enables a downward blast of air to be conducted from the conduit 530 into the chamber 212*a*. This downward blast or flow of air causes the fine particles of coating material in the aerosol in the chamber 212*a* to move downward to the bearing assembly 46*a* on the turntable 160*a*. Once this has happened, the solenoid 534 is de-energized and the air flow control valve 536 is operated to a closed condition to stop the flow of air into the chamber 212*a*.

Conclusion

The present invention provides a new and improved automated coating system 44. Although the automated coating system 44 may be used to sequentially coat many different articles, it is advantageously utilized to coat bearing assemblies 46 having inner and outer races 48 and 50.

The automated coating system includes a first coating station 102 (FIG. 3) where coating material is applied to each of the bearing assemblies 46 in turn while a first side of each bearing assembly faces upward. A conveyor 78 sequentially moves bearing assemblies from the first coating station to a turning station 108. At the turning station 108, the bearing assemblies 46 are turned over. The conveyor 78 moves the bearing assemblies 46 from the turning station 108 to a second coating station 114 where coating material is applied to each of the bearing assemblies 46 in turn. The conveyor 78 then sequentially moves the bearing assemblies to a rotating station 120 where relative rotation occurs between the inner and outer races 48 and 50 of the bearing assemblies.

At the coating stations 102 and 114, a housing 210 or 292 has a chamber 212 into which the bearing assemblies 46 are sequentially moved. A coating material flow control apparatus 224 or 498 directs a flow of coating material and compressed fluid into the chamber 212 to form an aerosol of fine particles of coating material in the chamber. The coating material and compressed fluid may advantageously be supplied to the coating material flow control apparatus 224 and 498 at the coating stations 102 and 114 as a mixture which is conducted from an accumulator 142 to the coating material flow control apparatus.

Having described the invention, the following is claimed:

1. An automated coating system for use in coating bearing assemblies having inner and outer races, said automated coating system comprising a first coating station, apparatus at said first coating station to apply coating material to each of the bearing assemblies in turn while a first side of each of the bearing assemblies faces upward, a turning station, apparatus at said turning station to sequentially turn each of the bearing assemblies over so that the first side of each of the bearing assemblies faces downward and a second side faces upward, a second coating station, apparatus at said second coating station to apply coating material to each of the bearing assemblies in turn while the second side of each of the bearing assemblies faces upward, a rotating station, apparatus at said rotating station to effect relative rotation between inner and outer races of each of the bearing assemblies in turn, and a conveyor assembly extending between each of said stations and operable to sequentially move the bearing assemblies between said stations.

2. An automated coating system as set forth in claim 1 wherein said apparatus at said first coating station includes a housing having a chamber into which each of the bearing assemblies is moved in turn by said conveyor assembly and a coating material flow control assembly operable to direct a flow of coating material and compressed fluid into the chamber to form an aerosol of fine particles of coating material in the chamber.

3. An automated coating system as set forth in claim 2 wherein the compressed fluid is carbon dioxide which enters the chamber mixed with the coating material and expands in the chamber to form the aerosol of fine particles of coating material.

4. An automated coating system as set forth in claim 2 wherein an air flow inlet to the chamber is located above a bearing assembly disposed in the chamber and an air flow outlet from the chamber is located below a bearing assembly disposed in the chamber, said apparatus at said first coating station includes an apparatus which is operable to cause a current of air to flow along a path which extends from the air flow inlet, around a bearing assembly in the chamber, and through the outlet from the chamber.

5. An automated coating system as set forth in claim 2 wherein said apparatus at said first coating station includes heating means for heating said coating material flow control assembly.

6. An automated coating system as set forth in claim 2 wherein said apparatus at said second coating station include a housing having a chamber into which each of the bearing assemblies is moved in turn by said conveyor assembly and a coating material flow control assembly operates to direct a flow of coating material and compressed fluid into the chamber at said second coating station to form an aerosol of fine particles of coating material in the chamber at said second coating station.

7. An automated coating system as set forth in claim 6 wherein the compressed fluid which flows into the chamber at said second coating station is carbon dioxide which enters the chamber at said second coating station mixed with the coating material and expands in the chamber at said second coating station to form the aerosol of fine particles of coating material.

8. An automated coating system as set forth in claim 6 wherein an air flow inlet to the chamber at the second coating station is located above a bearing assembly disposed in the chamber at the second coating station and an air flow outlet from the chamber at the second coating station is located below a bearing assembly disposed in the chamber at the second coating station, said apparatus at said second coating station includes an apparatus which is operable to cause a current of air to flow along a path which extends from the air flow inlet to the chamber at the second coating station, around a bearing assembly in the chamber at the second coating station, and through the outlet from the chamber at the second coating station.

9. An automated coating system as set forth in claim 6 wherein said apparatus at said second coating station includes heater means for heating said coating material flow control assembly at said second coating station.

10. An automated coating system as set forth in claim 1 wherein said apparatus at said turning station to sequentially turn each of the bearing assemblies includes a gripper assembly which is operable to grip an outer race of each of the bearing assemblies in turn and a drive assembly which is connected with said gripper assembly and is operable to rotate said gripper assembly about an axis extending transversely to a central axis of a bearing assembly gripped by said gripper assembly.

11. An automated coating system as set forth in claim 1 wherein said apparatus at said rotating station to effect relative rotation between inner and outer races of each of said bearing assemblies includes a gripper assembly which is operable to grip the outer race of each of the bearing assemblies in turn and a drive assembly which engages the inner race of each of the bearing assemblies in turn and rotates the inner race of each of the bearing assemblies in turn while the outer race is gripped by said gripper assembly.

12. An automated coating system as set forth in claim 1 wherein said apparatus at said rotation station to effect relative rotation between inner and outer races of each of said bearing assemblies includes a gripper assembly which is operable to grip the outer race of each of the bearing assemblies in turn and a drive assembly which engages the inner race of each of the bearing assemblies in turn and oscillates the inner race of each of the bearing assemblies in turn while the outer race is gripped by said gripper assembly.

13. An automated coating system as set forth in claim 1 wherein said stations are disposed in a circular array and said conveyor assembly includes a bearing assembly support which is rotatable about a central axis of the circular array of stations.

14. An automated coating system as set forth in claim 1 wherein said apparatus at said first coating station to apply coating material to each of the bearing assemblies in turn while a first side of each of the bearing assemblies faces upward includes a housing having a chamber into which each of the bearing assemblies is moved in turn by said conveyor assembly, a coating material flow control assembly connected with said housing and operable to direct a flow of coating material and compressed fluid into the chamber to form an aerosol of fine particles of coating material in the chamber, an apparatus connected with said housing and operable to cause a current of air to flow along a flow path which extends around a bearing assembly in the chamber while the bearing assembly is disposed on said conveyor assembly, said conveyor assembly being operable to sequentially move the bearing assemblies into and out of the chamber in said housing and to support each of the bearing assemblies in turn in the chamber in said housing during operation of said coating material flow control assembly to direct a flow of coating material and compressed fluid into the chamber.

15. An automated coating system as set forth in claim 14 further including heater means connected with said housing for heating said coating material flow control assembly.

16. An automated coating system as set forth in claim 15 wherein said compressed fluid which flows into the chamber is carbon dioxide which enters the chamber mixed with the coating material and expands in the chamber to form an aerosol of fine particles of coating material.

17. An automated coating system as set forth in claim 14 further including a baffle arrangement connected with said housing and defining a plurality of nonlinear flow paths along which a flow of air and coating material is conducted to remove at least a portion of the coating material from the flow of air and coating material.

18. An automated coating system as set forth in claim 14 further including a mixer connected in fluid communication with said coating material flow control assembly, said mixer being operable to mix coating material with compressed fluid, and a conduit connected in fluid communication with said mixer and said coating material flow control assembly to conduct a flow of a mixture of coating material and compressed fluid to said coating material flow control assembly.

19. An automated coating system as set forth in claim 18 further including an accumulator connected in fluid communication with said mixer, said accumulator including a container which receives and holds a mixture of coating material and compressed fluid conducted from said mixer to said accumulator, said conduit being connected in fluid communication with said container to enable a mixture of coating material and compressed fluid to be conducted from said container through said conduit to said coating material flow control assembly.

20. An automated coating system as set forth in claim 19 further including heater means for heating the mixture of coating material and compressed fluid prior to conducting the mixture of coating material and compressed fluid to said coating material flow control assembly.

21. An automated coating assembly as set forth in claim 1 wherein said conveyor assembly includes a support on which a bearing assembly is supported at the first coating station during application of coating material to the bearing assembly, said apparatus at said first coating station to apply coating material includes a coating material flow control assembly which is operable to provide a flow of coating material and compressed fluid to form an aerosol of fine particles of coating material and an apparatus which is operable to cause a current of air and fine particles of coating material to flow through openings in said support to thereby promote engagement of particles of coating material with a bearing assembly disposed on said support.

22. An automated coating system as set forth in claim 21 further including heater means for heating said coating material flow control assembly.

23. An automated coating system for use in coating bearing assemblies having inner and outer races, said automated coating system comprising a plurality of coating stations, a plurality of coating material flow control assemblies, each of said coating material flow control assemblies being disposed at one of said coating stations, a mixer which is operable to mix coating material with compressed fluid, an accumulator connected in fluid communication with said mixer, said accumulator including a container which receives a mixture of coating material and compressed fluid from said mixer and holds the mixture of coating material and compressed fluid under pressure, conduit means for conducting the mixture of coating material and compressed fluid to each of the coating material flow control assemblies and for conducting the mixture of coating material and compressed fluid from each of the coating material flow control assemblies to said container, a plurality of turning stations, apparatus at each of said turning stations to sequentially turn bearing assemblies from a first orientation to a second orientation, a plurality of conveyor assemblies, each of said conveyor assemblies extending from a first coating station of said plurality of coating stations through one of said turning stations of said plurality of turning stations to a second coating station of said plurality of coating stations to sequentially convey bearing assemblies from said first coating stations to said turning stations and from said turning stations to said second coating stations, said plurality of coating material flow control assemblies including first coating material flow control assemblies each of which is disposed at one of said first coating stations and is operable to sequentially apply coating material to bearing assemblies which are in the first orientation, said plurality of coating material flow control assemblies includes second coating material flow control assemblies each of which is disposed at one of said second coating stations and is operable to sequentially apply coating material to bearing assemblies which are in the second orientation, a plurality of rotating stations, apparatus at each of said rotating stations to sequentially effect rotation between inner and outer races of bearing assemblies, each of the conveyor assemblies extending between a second coating station of said plurality of coating stations and one of said rotating stations to sequentially convey bearing assemblies from said second coating stations to said rotating stations.

24. An automated coating system as set forth in claim 23 wherein each of said first coating stations includes a housing having a chamber into which articles are sequentially moved by one of said conveyor assemblies of said plurality of conveyor assemblies with the articles in the first orientation, each of said coating material flow control assemblies of said first plurality of coating material flow control assemblies being operable to direct a flow of the mixture of coating material and compressed fluid into the chamber at one of said first coating stations to form an aerosol of fine particles of coating material in the chamber, each of said second coating stations includes a housing having a chamber into which articles are sequentially moved by one of said conveyor assemblies of said plurality of conveyor assemblies with the articles in the second orientation, each of said coating material flow control assemblies of said second plurality of coating material flow control assemblies being operable to direct a flow of the mixture of coating material and compressed fluid into the chamber at one of said second coating stations to form an aerosol of fine particles of coating material in the chamber.

25. An automated coating system as set forth in claim 24 wherein the compressed fluid is carbon dioxide which enters the chambers at said first and second coating stations mixed with the coating material and expands in the chambers to form the aerosol of fine particles of coating material.

26. An automated coating system as set forth in claim 23 further including first heater means for heating the mixture of coating material and compressed fluid before it is conducted to said coating material flow control assemblies, and a plurality of second heater means for heating said plurality of coating material flow control assemblies.

27. An automated coating system as set forth in claim 23 wherein each of said coating stations includes a housing having a chamber into which articles are sequentially moved, one of said coating material flow control assemblies being connected with said housing and operable to direct a flow of coating material and compressed fluid into the chamber to form an aerosol of fine particles of coating material in the chamber, said housing having an air flow inlet to the chamber in said housing and an airflow outlet from the chamber in said housing, an apparatus connected with said housing and operable to cause a current of air to flow along a path which extends from the airflow inlet, around an article in the chamber and through the airflow outlet, said automated coating system further including a conveyor which is operable to sequentially move articles into and out of the chamber in said housing.

28. An automated coating system as set forth in claim 27 wherein each of said coating stations includes heater means connected with said housing for heating said one of said coating material flow control assemblies, said heater means being mounted on said housing adjacent to said one of said coating material flow control assemblies.

29. An automated coating system as set forth in claim 27 wherein said compressed fluid which flows into the chamber is carbon dioxide which enters the chamber mixed with the coating material and expands in the chamber to form an aerosol of fine particles of coating material.

30. An automated coating system as set forth in claim 27 wherein each of said coating stations includes a baffle arrangement connected with said housing and defining a plurality of nonlinear flow paths along which a flow of air and coating material is conducted to remove at least a portion of the coating material from the flow of air and coating material.

* * * * *